US006540590B1

(12) United States Patent
Kajiwara et al.

(10) Patent No.: US 6,540,590 B1
(45) Date of Patent: Apr. 1, 2003

(54) CHEMICAL MECHANICAL POLISHING APPARATUS AND METHOD HAVING A ROTATING RETAINING RING

(75) Inventors: Jiro Kajiwara, Cupertino, CA (US); Huey-Ming Wang, Fremont, CA (US)

(73) Assignee: Multi-Planar Technologies, Inc., San Jose, CA (US)

( * ) Notice: Subject to any disclaimer, the term of this patent is extended or adjusted under 35 U.S.C. 154(b) by 0 days.

(21) Appl. No.: 09/652,854

(22) Filed: Aug. 31, 2000

(51) Int. Cl.[7] ..... B24B 1/00

(52) U.S. Cl. ..... 451/41; 41/288; 41/287; 41/289; 41/285

(58) Field of Search ..... 451/41, 289, 388, 451/290, 285, 287, 254, 256, 288

(56) References Cited

U.S. PATENT DOCUMENTS

| | | | | |
|---|---|---|---|---|
| 4,752,250 A | | 6/1988 | Seidler | |
| 4,909,746 A | | 3/1990 | Scholz | |
| 4,918,869 A | | 4/1990 | Kitta | |
| 5,205,082 A | | 4/1993 | Shendon et al. | |
| 5,297,364 A | | 3/1994 | Tuttle | |
| 5,374,204 A | | 12/1994 | Foley et al | |
| 5,509,814 A | | 4/1996 | Mosquera | |
| 5,518,410 A | | 5/1996 | Masami | |
| 5,582,534 A | | 12/1996 | Shendon et al. | |
| 5,584,746 A | | 12/1996 | Tanaka et al. | |
| 5,584,751 A | | 12/1996 | Kobayashi et al. | |
| 5,635,083 A | | 6/1997 | Breivogel et al. | |
| 5,643,053 A | | 7/1997 | Shendon | |
| 5,643,061 A | * | 7/1997 | Jackson et al. | 451/289 |
| 5,651,724 A | | 7/1997 | Kimura et al. | |
| 5,653,601 A | | 8/1997 | Martucci et al. | |
| 5,681,215 A | * | 10/1997 | Sherwood et al. | 451/388 |
| 5,857,899 A | | 1/1999 | Volodarsky et al. | |
| 5,913,718 A | | 6/1999 | Shendon | |
| 5,913,719 A | | 6/1999 | Hasegawa et al. | |
| 5,916,015 A | * | 6/1999 | Natalicio | 451/288 |
| 5,931,725 A | | 8/1999 | Inaba et al. | |
| 5,980,361 A | | 11/1999 | Müller et al. | |
| 6,007,349 A | | 12/1999 | Distefano et al. | |
| 6,007,411 A | | 12/1999 | Feeney | |
| 6,019,671 A | | 2/2000 | Shendon | |
| 6,093,651 A | | 7/2000 | Andideh et al. | |
| 6,110,012 A | | 8/2000 | Maury et al. | |
| 6,224,472 B1 | * | 5/2001 | Lai et al. | 451/398 |
| 2001/0039172 A1 | | 11/2001 | Kimura | |

FOREIGN PATENT DOCUMENTS

| | | |
|---|---|---|
| EP | 0747167 A2 | 12/1996 |
| EP | 0841123 A1 | 5/1998 |
| EP | 0878270 A2 | 11/1998 |
| EP | 0881039 A2 | 12/1998 |
| EP | 0922531 A1 | 6/1999 |
| EP | 0992322 A1 | 4/2000 |
| EP | 1053830 A2 | 11/2000 |
| JP | 09057612 | 3/1997 |

(List continued on next page.)

*Primary Examiner*—Lee Wilson
(74) *Attorney, Agent, or Firm*—Dorsey & Whitney LLP

(57) ABSTRACT

A polishing apparatus (100) and method for polishing and planarizing a substrate (105) is provided that achieves a high-planarization uniformity across the substrate. In one embodiment, the polishing head (140) includes a carrier (155), a subcarrier (160) carried by the carrier and adapted to hold the substrate (105) during a polishing operation and a retaining ring (170) rotatably disposed about the subcarrier. The retaining ring (170) has a lower surface (205) that is substantially flush with the surface of the substrate (105) and is in contact with a polishing surface (125) during the polishing operation. The retaining ring (170) is capable of rotating relative to the substrate (105) held on the subcarrier (160) to inhibit non-planar polishing of the surface of the substrate. In another embodiment, the polishing head (140) further includes a backing ring (210) in a facing relationship with an upper surface (255) of the retaining ring (170) and separated from the retaining ring by a bearing (260).

22 Claims, 10 Drawing Sheets

FOREIGN PATENT DOCUMENTS

| | | |
|---|---|---|
| JP | 10156712 | 6/1998 |
| JP | 11165255 | 6/1999 |
| JP | 11216663 | 8/1999 |
| JP | 2000117620 | 4/2000 |
| WO | WO 9933614 A1 | 7/1999 |
| WO | WO 0021715 A2 | 4/2000 |
| WO | WO 0187541 A2 | 11/2001 |
| WO | WO 0191974 A1 | 12/2001 |

* cited by examiner

CHEMICAL MECHANICAL POLISHING APPARATUS AND METHOD HAVING A ROTATING RETAINING RING

FIELD

This invention pertains generally to systems, devices, and methods for polishing and planarizing substrates, and more particularly to a Chemical Mechanical Planarization or Polishing (CMP) apparatus and method.

BACKGROUND

Chemical Mechanical Planarization or Polishing, commonly referred to as CMP, is a method of planarizing or polishing semiconductor and other types of substrates. Planarizing a surface of a semiconductor substrate or wafer between certain processing steps allows more circuit layers to be built vertically onto a device. As feature size decreases, density increases, and the size of the semiconductor wafer increase, CMP process requirements become more stringent. Wafer to wafer process uniformity as well as uniformity of planarization across the surface of a wafer are important issues from the standpoint of producing semiconductor products at a low cost. As the size of structures or features on the semiconductor wafer surface have been reduced to smaller and smaller sizes, now typically about 0.2 microns, the problems associated with non-uniform planarization have increased. This problem is sometimes referred to as a Within Wafer Non-Uniformity (WIWNU) problem.

Many reasons are known in the art to contribute to uniformity problems. These include the manner in which wafer backside pressure is applied to the wafer during planarization, edge effect non-uniformities arising from the typically different interaction between the polishing pad at the edge of the wafer as compared to at the central region, and non-uniform deposition of metal and/or oxide layers to might desirably be compensated for by planarizing or adjusting the material removal profile during polishing. Efforts to simultaneously solve these problems have not heretofore been completely successful.

With respect to the nature of the wafer backside polishing pressure, conventional machines typically use hard backed polishing heads to press the wafer against a polishing surface, that is heads having a hard receiving surface that presses directly against the backside of the semiconductor wafer. As a result any variation in the receiving surface of the head, or the presence of any material trapped between the wafer and the receiving surface results in a non-uniform application of pressure to the backside of the wafer. Thus, the front surface of the wafer typically does not conform to the polishing surface resulting in planarization non-uniformities. Moreover, such hard backed head designs often must utilize a relatively high polishing pressure (for example, pressure in the range between about 6 psi and about 8 psi) to provide any reasonable degree of conformity between the wafer and the polishing surface. Such relatively high pressures effectively deform the wafer causing too much material to be removed from some areas of the wafer will be removed and too little material from others resulting in bad planarization.

Attempts have been made to remedy the above problems with hard backed heads by providing an insert between the receiving surface and the wafer to be polished in an attempt to provide some softness in an otherwise hard backed system. This insert is frequently referred to as the wafer insert. These inserts are problematic because they frequently result in process variation leading to wafer-to-wafer variation. This variation is not constant or generally deterministic. One element of the variation is the absorption of water or other fluids such as slurry used in the polishing process. Because the amount of water absorbed by the insert tends to increase over its lifetime, there is frequently process variation from wafer-to-wafer. These process variations may be controlled to a limited extend by preconditioning the insert by soaking the insert in water prior to use and by replacing the insert before its characteristics change beyond acceptable limits. This tends to make the initial period of use more like the later period of use, however, this can increase equipment maintenance costs and decrease process throughput. Moreover, unacceptable process variations are still observed due to, for example, variations in the thickness of the insert, wrinkling of the insert and material being trapped between the hard backed head and the insert or the insert and the wafer.

Use of the insert has also required fine control of the entire surface to which the insert is adhered as any non-uniformity, imperfection, or deviation from planarity or parallelism of the head surface would typically be manifested as planarization variations across the wafer surface. For example, in conventional heads, an aluminum or ceramic plate is fabricated, then lapped and polished before installation in the head. Such fabrication increases the costs of the head and of the machine, particularly if multiple heads are provided.

On the other hand, when a soft backed head is used, the soft material of the insert does not distort the wafer as the wafer is pressed against the polishing pad. As a result, lower polishing pressures may be employed, and conformity of the wafer front surface to the polishing pad is achieved without distortion so that both polishing uniformity and good planarization may be achieved. Better planarization uniformity is achieved at least in part because the polishing rate on similar features from die to die on the wafer is the same.

In recent years, some attempts have been made to utilize soft backed heads, however, they have not been entirely satisfactory. One type of soft backed head is described in U.S. Pat. No. 6,019,671, to Shendon, hereby incorporated by reference. Shendon teaches a membrane or flexible member stretched across the lower surface of the head to form a chamber or cavity which is pressurized to press the substrate against the polishing surface. While a significant improvement over hard backed heads with or without inserts this approach is not wholly satisfactory for a number of reasons. One problem with this approach is that it does nothing to reduce or eliminate the non-uniformities due to material trapped between the membrane and the wafer. Another problem is the membrane prevents the use of vacuum to hold the wafer to the head during a load or unload operation. Moreover, the use of the membrane can actually increase non-uniformities by introducing new variables, such as variation in the thickness or flexibility of the membrane across its surface and possible wrinkling of an improperly installed membrane.

Other soft backed head designs use a seal between the edge of the wafer and the head to form a cavity which is then pressurized to directly press the wafer against the polishing surface during polishing and planarization. One approach is described in U.S. Pat. No. 5,635,083, to Breivogel, et al., hereby incorporated by reference. Breivogel teaches the use of a lip seal against the outer edge of the backside of said wafer to form a seal between the head and the wafer to which pressurized air is admitted. Unfortunately, while such an approach provides a soft backed head that eliminates some of the problems associated with hard backed heads and soft backed heads having membranes, it does not permit sufficient engagement between the wafer and the receiving surface to provide torque to the wafer in machines where the head rotates during the polishing operation. Another problem with this approach is that although vacuum can be used to hold the wafer to the head, because the wafer is supported only at the edge an unacceptable degree of bowing can occur resulting in damage to or loss of the wafer.

With respect to correction or compensation for edge polishing effects, attempts have been made to adjust the shape of the retaining ring and to modify a retaining ring pressure so that the amount of material removed from the wafer near the retaining ring is modified. Typically, more material is removed from the edge of the wafer, that is the wafer edge is over polished. In order to correct this over polishing, usually, the retaining ring pressure is adjusted to be somewhat higher than the wafer backside pressure so that the polishing pad in that area is somewhat compressed by the retaining ring and less material is removed from the wafer within a few millimeters of the retaining ring. However, even these attempts are not entirely satisfactory as the planarization pressure at the outer peripheral edge of the wafer is only indirectly adjustable based on the retaining ring pressure. It is not possible to extend the effective distance of a retaining ring compensation effect an arbitrary distance into the wafer edge. Neither is it possible to independently adjust the retaining ring pressure, edge pressure, or overall backside wafer pressure to achieve a desired result.

Another problem with the retaining ring in conventional CMP heads is that any given point on the lower surface of the retaining ring corresponds to a given part of a wafer held on the subcarrier throughout the polishing operation. Thus, high or low spot on the lower surface of the retaining ring will result in non-planar polishing of the wafer. Although, it is possible to machine the lower surface of the retaining ring to have a high degree of flatness this is a costly option, especially since retaining rings are consumable components that wear as the wafer is polished and must frequently be replaced.

With respect to the desirability to adjust the material removal profile to adjust for incoming wafer non-uniform depositions, few if any attempts have been made to provide method or machines that afford such compensation. Non-uniform depositions can arise from the structure of circuits formed on the wafer or from characteristics of the deposited layers. For example, copper layers, which have become increasingly common in high-speed integrated circuits tend to form a convex layer thicker at the center of the wafer than the edge. Thus, it would be desirable to have a polishing method and an apparatus that provided a higher removal rate near the center of the wafer than at the edge.

A final problem with conventional CMP apparatuses and methods is the inefficient use and wastage of slurry. Slurry is a, usually, chemically active liquid having an abrasive material suspended therein that is used to enhance the rate at which material is removed from the substrate surface. Because the slurry is dispensed onto the polishing surface ahead of the head, an excess of slurry must typically be dispensed to ensure that when it flows across the polishing surface it will cover the entire area between the wafer and the surface. Because of strict requirements concerning the purity of the slurry and in particular the size of the abrasive particles suspended therein, slurry tends to be expensive. Moreover, to avoid contamination and to provide consistent results slurry is generally not recirculated or recycled. Thus, a significant factor in the cost of operating conventional CMP apparatuses is the cost of the slurry.

Therefore, there remains a need for an apparatus and method that provides excellent planarization, controls edge planarization effects, and permits adjustment the wafer material removal profile to compensate for non-uniform deposition of layers on the wafer. There is a further need for an apparatus and method that enables the wafer to be held to the head by vacuum to a soft backed head while minimizing or eliminating stresses on the wafer. There is yet a further need for a CMP apparatus that provides a sufficient slurry to the polishing surface without excessive amount of wastage.

SUMMARY

The present invention relates to a CMP apparatus and method for polishing and planarizing substrates that achieves a high-planarization uniformity across the surface of the substrate, while providing a more efficient use of slurry in the polishing and planarizing processes.

According to one aspect of the present invention, polishing head for positioning a substrate having a surface on a polishing surface of a polishing apparatus is provided for processing the substrate to remove material therefrom. The polishing head includes a carrier, a subcarrier carried by the carrier and adapted to hold the substrate during a polishing operation and a retaining ring rotatably disposed about the subcarrier. The retaining ring has a lower surface substantially flush with a surface of a substrate held on the subcarrier, the lower surface of the retaining ring in contact with the polishing surface during processing. The retaining ring deforms the polishing surface to reduce the rate of removal of material from the edge of the substrate. With conventional carriers any variation or irregularity in the lower surface of the retaining ring cause a locally higher or lower removal rate of material from the edge of the substrate adjacent to the irregularity. However, with a carrier of the present invention, because the retaining ring is able to rotate relative to the subcarrier, and therefore the substrate, during processing, the impact of any variation in the lower surface of the retaining ring on the rate of removal of material from the edge of the substrate is minimized.

In one embodiment, the subcarrier is driven by a drive mechanism, and friction forces between the retaining ring and the polishing surface causes the retaining ring to rotate relative to the subcarrier. Alternatively, the retaining ring can be caused to rotate relative to the subcarrier by a separate drive mechanism coupled to the retaining ring.

In another embodiment, the carrier further includes a backing ring in a facing relationship with an upper surface of the retaining ring and separated from the retaining ring by a bearing. The backing ring is adapted to apply pressure to the retaining ring during the polishing operation. The bearing can be, for example, a ball bearing, fluid dynamic bearing, roller bearing or a taper bearing. Optionally, the retaining ring further includes a first lip that engages with a second lip on the backing ring when the carrier is lifted from the polishing surface to couple the retaining ring to the backing ring.

BRIEF DESCRIPTION OF THE DRAWINGS

These and various other features and advantages of the present invention will be apparent upon reading of the following detailed description in conjunction with the accompanying drawings, where.

DETAILED DESCRIPTION

Figure 1:
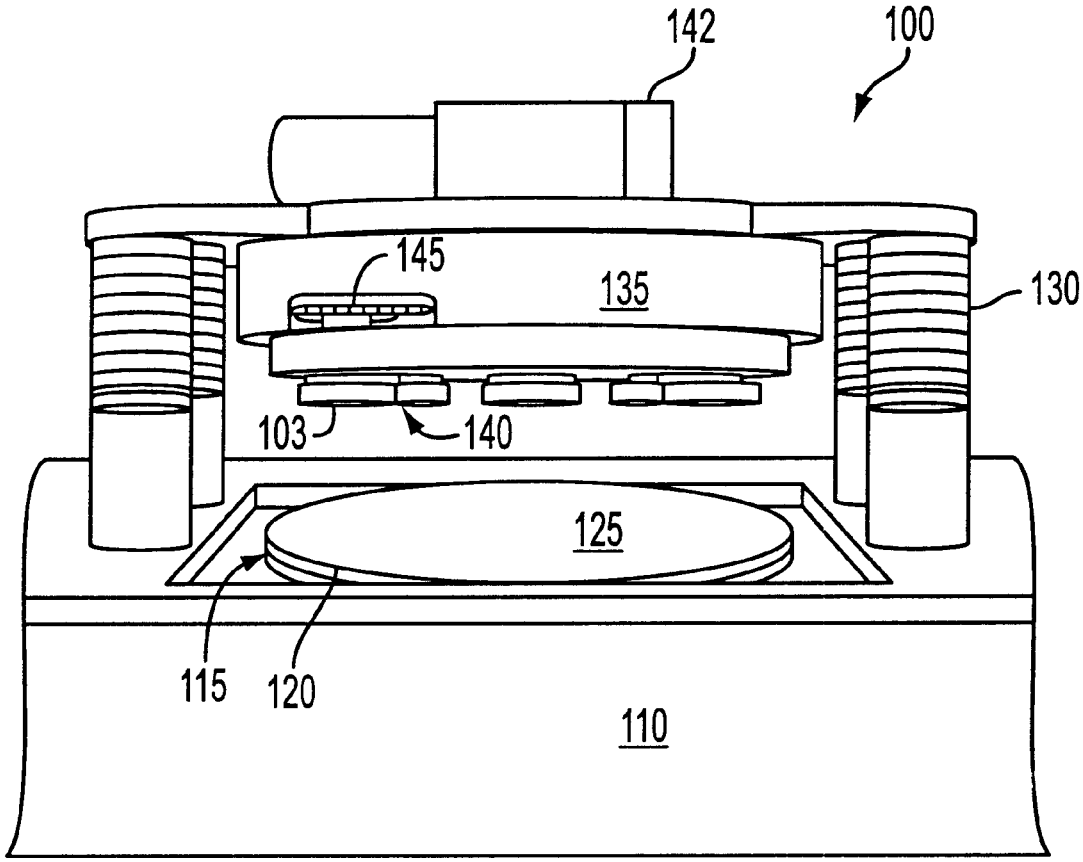
FIG. 1 (PRIOR ART)
FIG. 1 is a diagrammatic illustration showing an exemplary multi-head polishing or planarization apparatus.

An improved method and apparatus for polishing or planarization of substrates is provided. In the following description numerous embodiments are set forth including specific details such as specific structures, arrangement, materials, shapes etc. It will be obvious, however, to one skilled in the art that the present invention may be practiced without these specific details, and the method and apparatus of the present invention is not so limited. Referring to FIG. 1, there is shown an embodiment of a chemical mechanical polishing or planarization (CMP) apparatus 100 for polishing substrates 105. As used here the term "polishing" means either polishing or planarization of substrates 105, including substrates used in flat panel displays, solar cells and, in particular, semiconductor substrates or wafers onto which electronic circuit elements have been deposited. Semiconductor wafers are typically thin and fragile disks having diameters nominally between 100 mm and 300 mm. Currently 100 mm, 200 mm, and 300 semiconductor wafers are widely used in the industry. The inventive method and apparatus 100 are applicable to semiconductor wafers and other substrates 105 at least up to 300 mm diameter as well as to larger diameter substrates.

For purposes of clarity, many of the details of the CMP apparatus 100 that are widely known and are not relevant to the present invention have been omitted. CMP apparatuses 100 are described in more detail in, for example, in commonly assigned, co-pending U.S. patent applications Ser. No. 09/570,370 filed May 12, 2000 and entitled System and Method for Pneumatic Diaphragm CMP Head Having Separate Retaining Ring and Multi-Region Wafer Pressure Control; Ser. No. 09/570,369, filed May 12, 2000 and entitled System and Method for CMP Having Multi-Pressure Zone Loading For Improved Edge and Annular Zone Material Removal Control; and U.S. Provisional Application Serial No. 60/204,212 filed May 12, 2000 and entitled System and Method for CMP Having Multi-Pressure Annular Zone Subcarrier Material Removal Control, each of which is incorporated herein by reference in its entirety.

The CMP apparatus 100 includes a base 110 rotatably supporting a large rotatable platen 115 with a polishing pad 120 mounted thereto, the polishing pad having a polishing surface 125 on which the substrate 105 is polished. The polishing pad 120 is typically a polyeurethane material, such as that available from RODEL of Newark Del. Additionally, a number of recesses (not shown in FIG. 1), such as grooves or cavities, may be provided in the polishing surface 125 to distribute a chemical or slurry between the polishing surface and a surface of a substrate 105 placed thereon. By slurry it is meant a chemically active liquid having an abrasive material suspended therein that is used to enhance the rate at which material is removed from the substrate surface. Typically, the slurry is chemically active with at least one material on the substrate 105 and has a pH of approximately 4 to 11. For example, one suitable slurry consists of approximately 12% abrasive and 1% oxidizer in a water base, and includes a colloidal silica or alumina having a particle size of approximately 100 nm. Optionally, as an alternative or in addition to the slurry, the polishing surface 125 of the polishing pad 120 can have a fixed abrasive material embedded therein, such as available from Minnesota Mining and Manufacturing Company. In embodiments of CMP apparatuses 100 having a polishing surface 125 with a fixed abrasive, the chemical dispensed onto the polishing surface during polishing operations can be water.

The base 110 also supports a bridge 130 that in turn supports a carousel 135 having one or more polishing heads 140 on which substrates 105 are held during a polishing operation. The bridge 130 is designed to permit raising and lowering of the carousel 135 to bring surfaces of substrates 105 held on the polishing heads 140 into contact with the polishing surface 125 during the polishing operation. The particular embodiment of a CMP apparatus 100 shown in FIG. 1 is a multi-head design, meaning that there are a plurality of polishing heads 140 for each carousel 135; however, single head CMP apparatuses 100 are known, and inventive polishing head 140, polishing surface 125 and methods for polishing may be used with either a multi-head or single-head type polishing apparatus 100. Furthermore, in this particular CMP design, each of the polishing heads 140 are driven by a single motor 142 that drives a chain 145, which in turn drives each of the polishing heads via a chain and sprocket mechanism (not shown); however, the invention may be used in embodiments in which each polishing head 140 is rotated with a separate motor and/or by other than chain and sprocket type drives. In addition to the rotation of the polishing pad 120 and the polishing heads 140, the carousel 135 can be moved to orbit about a fixed central axis of the polishing platen 115 to provide an orbital motion to the polishing heads. Furthermore, the inventive polishing head 140 may be utilized in all manner of CMP apparatuses 100 including machines utilizing a linear or reciprocating motion as are well known in the art.

The CMP apparatus 100 also incorporates a chemical dispensing mechanism (not shown in FIG. 1) to dispense a chemical or slurry, as described above, onto the polishing surface 125 during the polishing operation, a controller (not shown) to control the dispensing of the slurry and movement of the polishing heads 140 on the polishing surface, and a rotary union (not shown) to provide a number of different fluid channels to communicate pressurized fluids such as air, water, vacuum, or the like between stationary sources external to the polishing head and locations on or within the polishing head.

Figure 2:
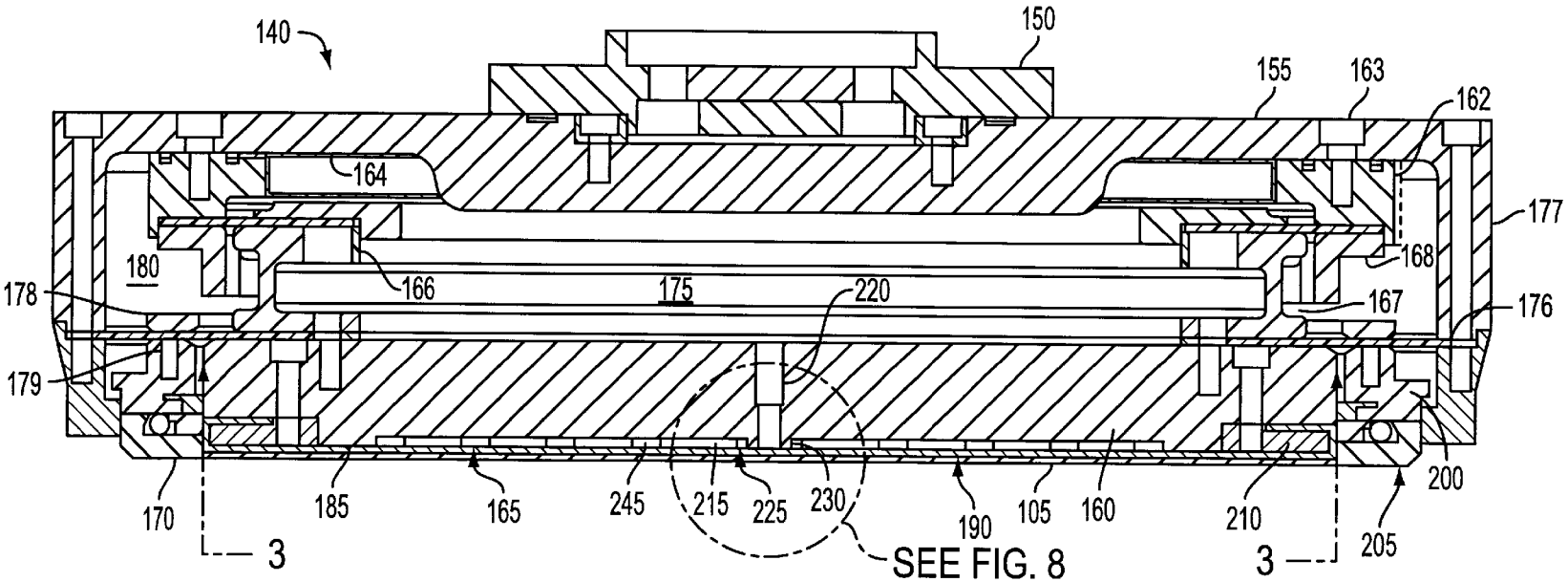
FIG. 2 is a diagrammatic illustration showing a cross-sectional side view of a polishing head according to an embodiment of the present invention.

An embodiment of a polishing head 140 according to the present invention will now be described with reference to FIG. 2. Referring to FIG. 2, the polishing head 140 includes a head mounting assembly 150 for attaching the polishing head to the carousel 135 and a carrier 155 for holding and positioning the substrate 105 on the polishing surface 125 during the polishing operation. The carrier 155 typically includes a subcarrier 160 having a lower surface 165 on which the substrate 105 is held and a retaining ring 170 circumferentially disposed about a portion of the subcarrier.

The subcarrier 160 and the retaining ring 170 are suspended from the carrier 155 so that they can move vertically with little friction and no binding. Small mechanical tolerances are provided between the subcarrier 160 and the retaining ring 170 and adjacent elements so that they are able to float on the polishing surface 125 in a manner that accommodates minor angular variations during the polishing operation. Referring to FIG. 2, a flange 162 attaches via screws 163 or other fasteners to an inner lower surface 164 of the carrier 155. The flange 162 is joined via a flexible membrane or gasket 166 to an inner support ring 167 and an outer support ring 168 to flexibly support the subcarrier 160 and define a closed chamber or cavity 175 above the subcarrier 160. The retaining ring 170 is supported by a second flexible membrane or gasket 176 extending between the subcarrier 160 and a skirt portion 177 of the carrier 155. The retaining ring 170 is coupled to the second gasket 176 via an adhesive (not shown) or via screws 179 or other fasteners that attach to a backing plate 178 on the opposite side of the gasket, as shown in FIG. 2. The flange 162, lower skirt portion 177, the inner and outer support rings 167, 168, and the second gasket form a second closed cavity 180 above the retaining ring 170.

In operation, the subcarrier 160 and the retaining ring 170 are independently biased or pressed against the polishing surface 125 while providing a slurry and relative motion between the substrate 105 and the polishing surface 125 to polish the substrate. The biasing force can be provided by springs (not shown) or by the weight of the subcarrier 160 and the retaining ring 170 themselves. Preferably, as shown in FIG. 2, the subcarrier 160 and the retaining ring 170 are pressed against the polishing surface 125 by a pressurized fluid introduced into closed cavities or chambers 175, 180, above the subcarrier 160 and the retaining ring 170 respectively. The use of a pressurized fluid is preferred since the application of the force is more uniform and more readily altered to adjust the polishing or removal rate. Generally, the pressure applied is in the range of between about 4.5 and 5.5 psi, more typically about 5 psi. However, these ranges are only exemplary as any of the pressures may be adjusted to achieve the desired polishing or planarization effects over the range from about 2 psi and about 8 psi. More preferably, the biasing force or pressure applied to the retaining ring 170 is greater than that applied to the subcarrier 160 to slightly deform the polishing surface 125 thereby reducing the so called edge effect providing a more uniform rate of removal and planarization across the surface of the substrate 105. The edge effect refers to the tendency for the rate of removal to be greater at the edge of the substrate 105 than at a central portion due to the interaction of the polishing surface 125 with the edge of the substrate. By pressing down on and slightly deforming the polishing surface 125 near the edge of the substrate 105 the retaining ring 170 reduces the force with which the edge of the substrate is pressed against the polishing surface, thereby lowering the local removal rate to a level more nearly equal to that of other areas across the substrate surface.

In accordance with the present invention, the subcarrier 160 can include on the lower surface 165 a soft insert, such as flexible member 185 or membrane, having a receiving surface 190 on which the substrate 105 is received. The flexible member 185 has a thickness having a plurality of openings or holes 195 extending through the thickness to the receiving surface 190 to apply a pressurized fluid, at least in part, directly against a backside of the substrate 105 to press the substrate directly against the polishing surface 125. Generally, the pressure applied is in the range of between about 2 and 8 psi, more typically about 5 psi. Preferably, the number and size of the holes 195 is selected to maximize the area of the substrate 105 exposed directly to the pressurized fluid while providing a sufficient area of the receiving surface 190 in engaging or in contact with the substrate 105 to impart torque or rotational energy from the polishing head 140 to the substrate during the polishing operation. The advantages of the flexible member 185 of the present invention include: (i) the ability to reduce or eliminate the impact of particles or impurities caught between the receiving surface 190 and the substrate 105 on polishing uniformity by reducing the area in which such particles could be trapped; (ii) the ability to reduce or eliminate non-uniformities in polishing due to wrinkling of the substrate; and (iii) the ability to reduce or eliminate non-uniformities in polishing due to variation in thickness of the flexible member 185. The flexible member 185 and the holes 195 or openings therein are described in greater detail hereinafter.

Additionally, the retaining ring 170 can be rotatably suspended from a backing ring 200 on the carrier 155 to enable it to rotate a different speed relative to the substrate 105 on the subcarrier 160 during the polishing operation. The backing ring 200 is adapted to apply pressure to the retaining ring 170 during the polishing operation. The advantages of providing a retaining ring 170 rotatably disposed about the substrate 105 are two-fold. First, because the substrate 105 and the retaining ring 170 rotate at different speeds no single point on a lower surface 205 of the retaining ring will correspond, lock-step to a single point on the edge of the substrate during the polishing operation. Thus, the effect of a high or low spot on the lower surface 205 of the retaining ring 170 on the removal rate at the edge of the substrate will be reduced if not eliminated, thereby inhibiting non-planar polishing of the surface of the substrate 105. Second, because the effect of high and low spots on the lower surface 205 of the retaining ring 170 is minimized, the lower surface 205 of the retaining ring need not be finished to a high degree of flatness, thereby reducing the cost of manufacturing the retaining ring. Moreover, since the retaining ring 170 is a consumable item, wearing as the substrate 105 is polished, lowering the cost of the retaining ring can greatly reduce operating costs over the life of the CMP apparatus 100. The rotating retaining ring 170 is described in greater detail hereinafter.

The flexible member 185 will now be described with reference to FIG. 2 and to FIGS. 3 through 7, which show various embodiments of the receiving surface 190 and the holes 195 therein. Referring again to FIG. 2, the flexible member 185 is typically made from a polymeric material which is non-reactive with the substrate 105 and chemicals used in the polishing operation, such as EPDM, EPR, silcone, or rubber, and is stretched over and separated from the lower surface 165 of the subcarrier 160 by an annular or ring shaped edge or corner ring piece 210 to form a lower cavity 215 defined by the lower surface 165 of the subcarrier 160, the corner ring piece 210, the flexible member 185 and the backside of a substrate 105 held on the receiving surface 190 of the flexible member 185. Pressurized fluid is introduced into the lower cavity 215 through a passageway 220 connected to a port 225 in the lower surface 165 of the subcarrier 160. The corner ring piece 210 can be made from a non-compressible or substantially non-compressible material such as metal, hard polymeric material, or the like; or, to further reduce the edge effect, from a compressible or resilient material such as soft plastic, rubber, silicone, or the like materials.

Figure 3:
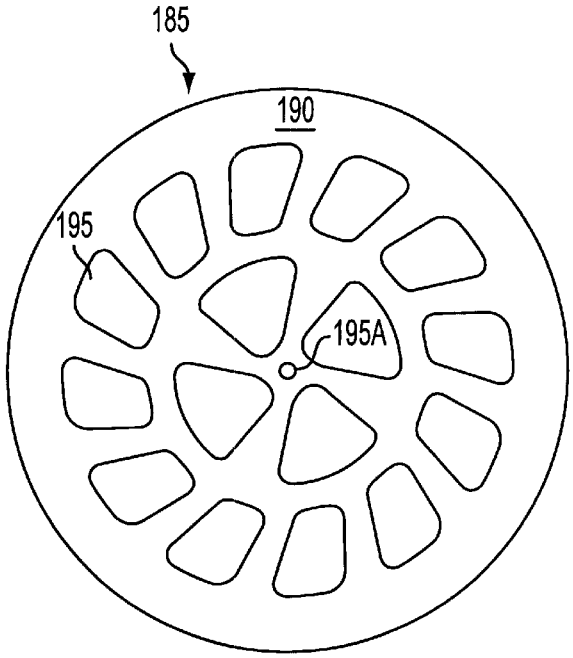
FIG. 3 is a plan view of a portion of the polishing head of FIG. 2 taken along the line 3—3 of FIG. 2 showing an embodiment of a flexible member according to the present invention.

Referring to FIG. 3, a plan view of the receiving surface 190 of the flexible member 185 according to an embodiment of the invention is shown. In this figure a number of holes 195 spaced regularly and symmetrically across the receiving surface 190 is shown. As noted above, the number and size of the holes 195 is selected to provide a sufficient area of the receiving surface 190 in contact with the substrate 105 to impart torque or rotational energy from the polishing head 140 to the substrate to cause the substrate to rotate during the polishing operation. It has been found that a receiving surface having a surface area wherein the total area of the holes 195 is from about 50 to about 90 percent of the surface area, and more preferably from about 66 to about 75 percent of the surface area provides sufficient engagement. In a preferred embodiment, the holes 195 can have an edge angled in relation to the direction of rotation of the polishing head 140 to stiffen the flexible member 185 to increase engagement between the flexible member and the substrate 105, thereby providing increased torque. For example, holes 195 having the shape shown in FIG. 3 would provide increased engagement when the polishing head is rotated in the clockwise direction.

Alternative designs and patterns for holes 195 in the receiving surface 190 of the flexible member 185 are shown in FIGS. 4 through 7.

Figure 4:
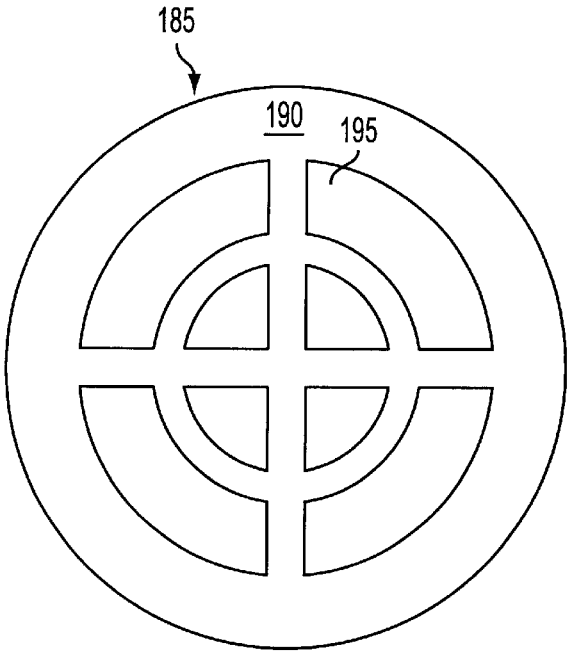
FIG. 4 is a plan view similar to FIG. 3 of an alternative embodiment of a flexible member according to the present invention.
Figure 5:
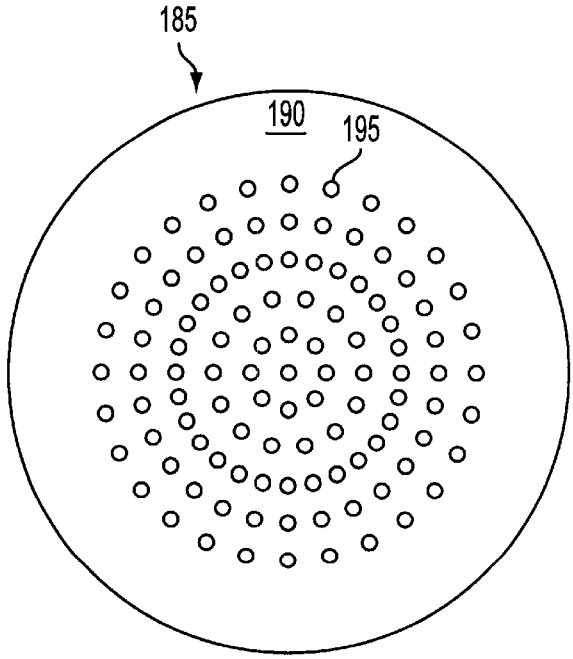
FIG. 5 is a plan view similar to FIG. 3 of another alternative embodiment of a flexible member according to the present invention.
Figure 6:
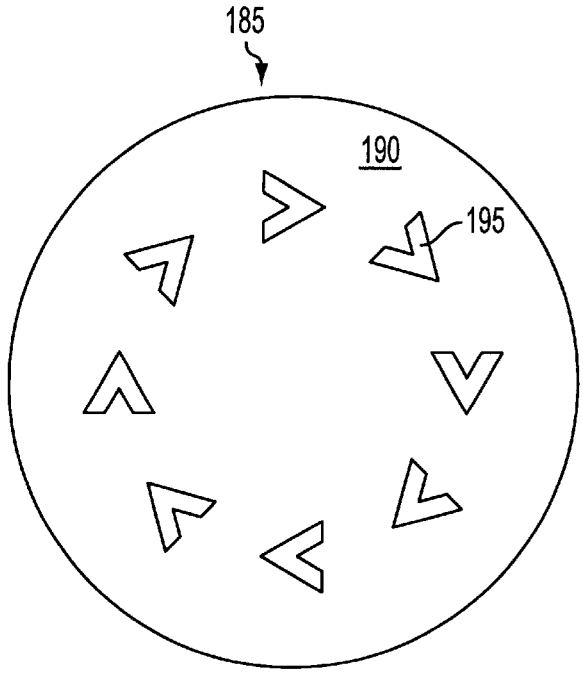
FIG. 6 is a plan view similar to FIG. 3 of yet another alternative embodiment of a flexible member according to the present invention.
Figure 7:
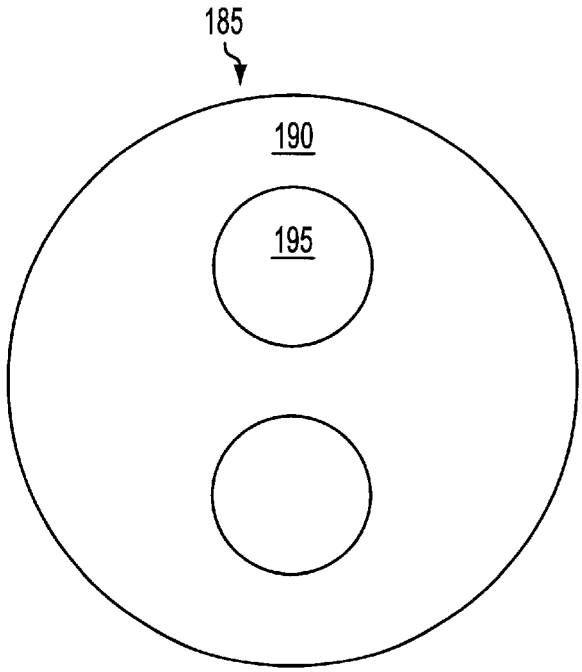
FIG. 7 is a plan view similar to FIG. 3 of still another alternative embodiment of a flexible member according to the present invention.

FIG. 4 is a diagrammatic illustration showing a plan view of an alternative embodiment of a flexible member 185 having fewer, larger holes 195 that are more regularly spaced and without an angled edge. FIG. 5 is a diagrammatic illustration showing a plan view of an alternative embodiment of a flexible member 185 having a large number of circular holes 195. Although in the embodiment shown the holes 195 all have equal diameter, it will be appreciated that the both the size and number of the holes an vary across the receiving surface 190 without deviating from the scope of the present invention. FIG. 6 is a diagrammatic illustration showing a plan view of another alternative embodiment of a flexible member 185 having a plurality of chevron or herringbone shaped holes 195 disposed circumferentially about the receiving surface 190 of the flexible member 185. Again, although not shown the flexible member 185 can have a second ring of holes 195 internal to and concentric with the first. The chevron shaped holes 195 in the second ring can be pointed in the same direction as the first or in the opposite direction. However, it has been found that orienting the chevrons in a direction opposite to the rotation of the polishing head 140 increases engagement between the flexible member 185 and the substrate 105, thereby providing increased torque. A plan view of yet another alternative embodiment of the flexible member 185 is shown in FIG. 7. In FIG. 7, the holes 195 comprise two relatively large openings or holes. Again, although shown as circular the holes 195 can have any regular or irregular shape including polygonal and elliptical, and each hole need not have the same shape or size as the other.

Figure 8:
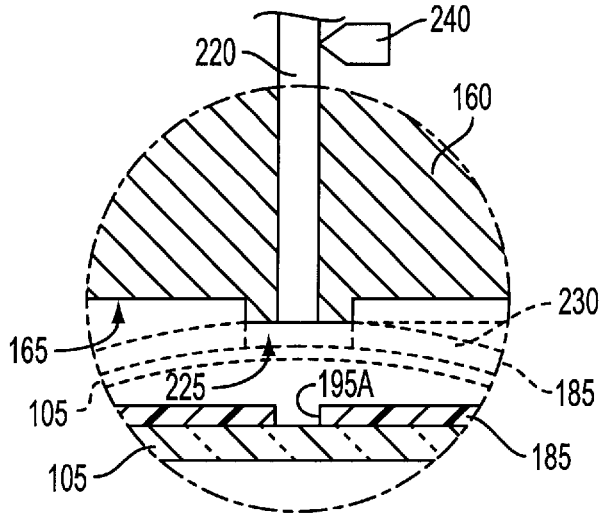
FIG. 8 is a cross-sectional view of the polishing head of FIG. 2 taken along the line 8—8 of FIG. 2 according to an embodiment of the present invention.

Referring to FIG. 8, in another aspect of the invention a raised lip 230 on the port 225 in the lower surface 165 of the subcarrier 160 and the flexible member 185 with the substrate 105 thereon are adapted to serve as an isolation valve 235 isolating the port 225 from the lower cavity 215 when the port 225 is used to draw a vacuum on the lower cavity. Vacuum is drawn on the lower cavity 215 hold the substrate 105 to the receiving surface 190 when it is not in contact with the polishing surface 225 during the polishing operation. For example, during load and unload operations before and after the polishing operation. A problem in prior art polishing heads having a soft insert and using a vacuum to hold the substrate to the head is that deformation of the insert produced stresses in the substrate, particularly near the edge of the substrate where the deformation of the insert from flat surface to a concave shape is greatest, that could lead damage or loss of the entire substrate. Depending on the point in processing at which the loss occurs, the loss of a semiconductor substrate could result in the loss of thousands of dollars. Accordingly, an advantage of the present invention is that by selecting the separation between the flexible member 185 and the lip 230 of the port 225, the port can be isolated from the lower cavity 215 when a predetermined vacuum has been achieved. The predetermined vacuum is selected to provide a sufficient force to hold the substrate 105 to the receiving surface 190 while reducing the deformation of the flexible member 185 and, thereby, reducing the stresses on the substrate. Optionally, the CMP apparatus 100 can further include a vacuum switch 240 or transducer, shown schematically in FIG. 8, coupled to the port 225 and which is used to sense the presence of a substrate 105 on the receiving surface 190 by switching or changing state when the predetermined vacuum has been achieved.

The holes 195 in the flexible member can be sized and located, as shown in FIG. 8, so that a hole 195A opposite the port 225 has a diameter smaller than the lip 230 around the port and an edge of the hole seals the port to the substrate 105. This embodiment has the advantage of enabling vacuum to act directly on the substrate 105 and evacuate and eliminate any air pockets between the substrate and the receiving surface 190. Alternatively, in another embodiment (not show) the size and placement of the holes 195 can be chosen so that a substantially unbroken area of the flexible flexible member 185 is opposite the port 225. This embodiment has the advantage of reducing or eliminating any possible failure of the isolation valve 235 due a misalignment of the hole 195 and the port 225.

Figure 9:
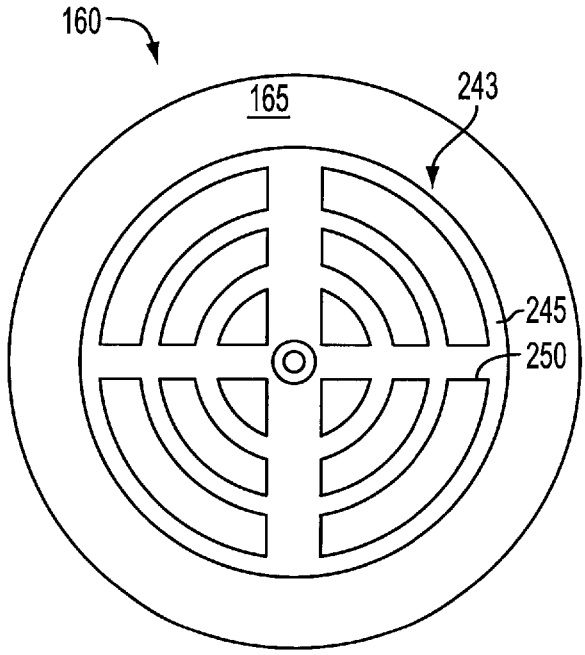
FIG. 9 is a diagrammatic illustration showing plan view a lower surface of a subcarrier having a grooved lower surface according to an embodiment of the present invention.

In another embodiment, shown in FIGS. 2 and 9, the lower surface 165 of the subcarrier 160 further includes a spacer 243 having one or more grooves or channels 245 disposed between the port 225 and outer portions of the lower cavity 215 to facilitate evacuating the lower cavity, and, during the polishing operation, to facilitate introducing pressurized fluid into the lower cavity. The spacer 243 can comprise a separate component positioned on or affixed to the lower surface 165 of the subcarrier 160 by an adhesive or a mechanical fastener (not shown). Alternatively, as shown in FIG. 9, the channels 245 are machined directly in the lower surface 165 of the subcarrier 160 to form the spacer 243. FIG. 9 is a diagrammatic illustration showing plan view the lower surface 165 of the subcarrier 160 having a number of symmetrically spaced radial channels 245 according to an embodiment of the present invention. In a further refinement of this embodiment, the separation between the flexible member 185 and raised portions or lands 250 between the channels 245 on the lower surface 165 is chosen to further reduce deformation of the flexible member 185 when vacuum is drawn on the lower cavity 215, thereby supporting the substrate 105, preventing excess bowing and further reducing the stresses on the substrate. The precise separation depends on a number of factors including the size or diameter of the substrate 105 and the receiving surface 190. It has been found that for a semiconductor substrate 105 having a diameter of about 200, a suitable separation is less than about 100 microns.

Figure 10:
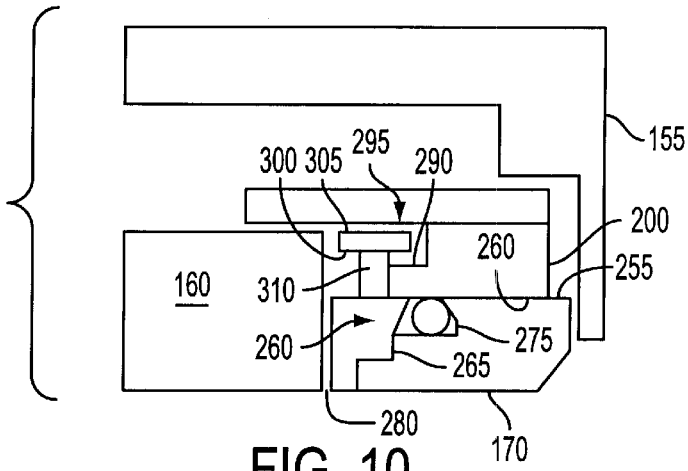
FIG. 10 is a diagrammatic illustration showing a partial cross-sectional view of a polishing head having a rotating retaining ring according to an embodiment of the present invention.

The rotating retaining ring 170 will now be described with reference to FIGS. 2 and 10, which show different embodiments of the rotating retaining ring. Referring again to FIG. 2, the retaining ring 170 has an upper surface 255 in a facing relationship with a lower surface 260 of the backing ring 200, and is separated from the backing ring by a bearing 260. The bearing 260 can be either a ball bearing, a fluid dynamic bearing, a roller bearing, or a taper bearing. In the embodiments shown in FIGS. 2 and 10 the bearing 260 is a roller bearing having an inner race or housing 265, a number of balls 270, and an outer race 275 formed in the retaining ring 170. In addition, a small annular space 280 is provided between the retaining ring 170 and the subcarrier 160 a so that they are able to rotate relative to one another during the polishing operation.

Preferably, the retaining ring 170 further includes a mechanism for coupling the it to the carrier 155 when the polishing head 140 is lifted from the polishing surface 125. In the embodiment shown in FIG. 2, the coupling is accomplished by a first lip 285 on the retaining ring 170 that engages with a second lip 290 on the backing ring 200 when the polishing head 140 is lifted from the polishing surface 125. In the embodiment shown in FIG. 10, the first lip 285 is formed using a number of bolts 295, each of the bolts having a shaft portion 300 threaded into the retaining ring 170 or the bearing housing 265 and a head 305 having a surface 310 projecting radially outward from the shaft portion to engage with the second lip 290 on the backing ring 200 when the carrier 155 is lifted from the polishing surface 125. Preferably, there are at least three bolts 295 evenly spaced about the circumference of the retaining ring 170 to securely couple the retaining ring to the backing ring 200.

As explained above, the rotating retaining ring 170 provides enhanced uniformity in the rate of removal of material across the surface of the substrate 105 and in planarization of the substrate by reducing if not eliminating the effect of a high or low spot on the lower surface 205 of the retaining ring 170. The retaining ring 170 may be rotated relative to the subcarrier 160 during the polishing operation by friction forces between the retaining ring and the polishing surface 125 that cause the retaining ring to rotate more slowly than the subcarrier 160 which is rotated by the drive mechanism. Alternatively, the retaining ring 170 can be rotated by a second drive mechanism coupled thereto. This second drive mechanism can be a separate motor 315 as shown in FIG. 10, or a gear or chain and sprocket drive coupled to the polishing head drive mechanism (not shown). An advantage of the embodiment relying on friction forces to rotate the retaining ring 170 is simplicity and durability of design. The advantage of the embodiment using a second drive mechanism is the ability to control the difference in rotation speed between the substrate 105 held on the subcarrier 160 and the retaining ring 170, and the ability to rotate the retaining ring in a direction opposite that of the subcarrier.

Figure 11:
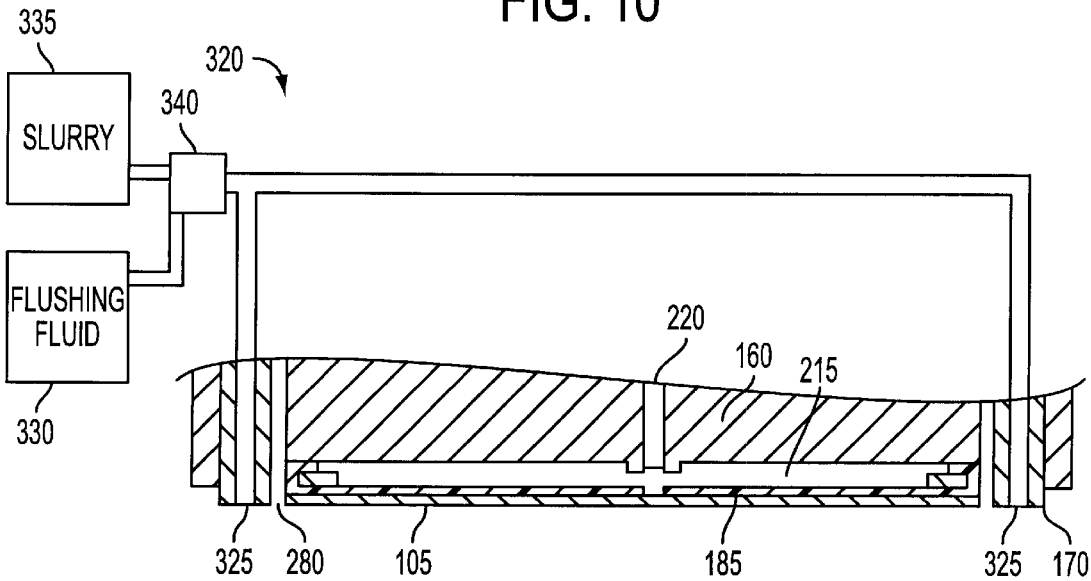
FIG. 11 is a diagrammatic illustration showing a partial cross-sectional view of a polishing head having an integral dispensing mechanism for dispensing a chemical onto a polishing surface according to an embodiment of the present invention.
Figure 12:
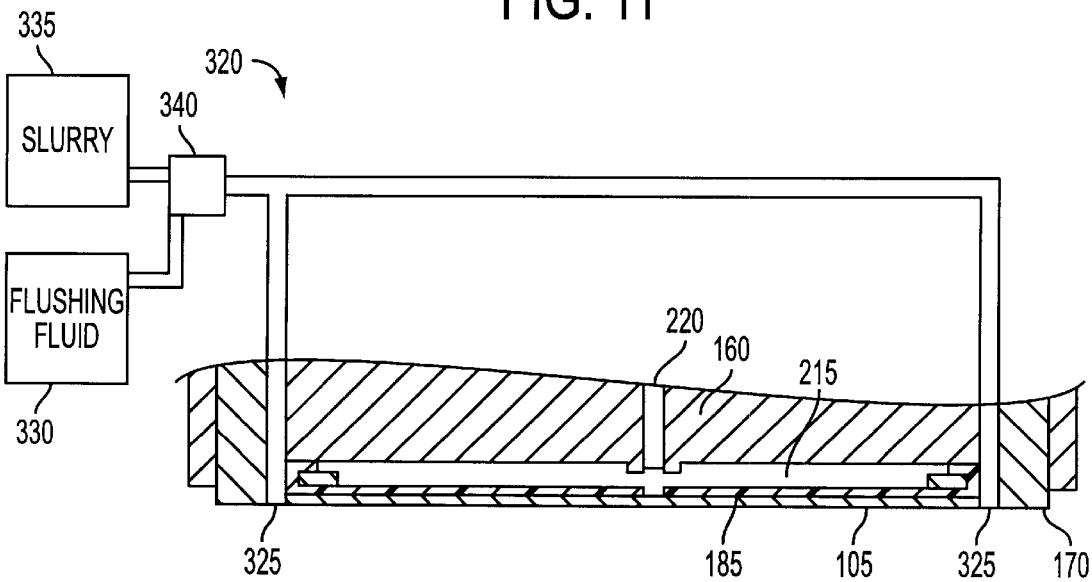
FIG. 12 is a diagrammatic illustration showing a partial cross-sectional view of a polishing head having an integral dispensing mechanism for dispensing a chemical onto a polishing surface through an annular space between a retaining ring and a subcarrier according to an alternative embodiment of the present invention.

In another aspect of the present invention, a polishing head 140 having an integral dispensing mechanism 320 is provided for dispensing a chemical or slurry onto the polishing surface 125 during the polishing operation. To avoid contamination and to provide consistent results slurry is generally not recirculated or recycled. Moreover, because of strict requirements on the purity of the slurry and in particular the size of the abrasive particle suspended therein, a significant factor in the cost of operating conventional CMP apparatus 100 is the cost of the slurry. One of the problems of conventional CMP apparatus 100 is that because the slurry is dispensed onto the polishing surface 125 ahead of the polishing head 140, an excess of slurry must be dispensed to ensure that when it flows across the polishing surface 125 it will cover the entire area between the substrate 105 and the polishing surface 125. A polishing head 140 according to the present invention includes a number of ports 325 position circumferentially in the carrier 155 or the retaining ring 170 surrounding the substrate 105, thereby ensuring the entire area between the substrate and the polishing surface 125 is covered, and reducing or eliminating any wastage of slurry. The size and number of the ports 325 are selected to provide adequate coverage and depend directly on the size of the substrates 105 being polished. Additionally, the size of the ports 325 is also selected to accommodate the viscosity and the particle size of the particular slurry used. For example, it has been found that to polish a 200 mm substrate 105 using a slurry having a viscosity of 1.5 centipoise and a particle size of 100 nm, from about 2 to about 20 ports having a diameter of from about 3 to about 1 mm, is sufficient. In one embodiment, shown in FIG. 11, the slurry is dispensed from ports 325 evenly spaced about the lower surface 205 of the retaining ring 170. In another embodiment, shown in FIG. 12, the ports 325 are disposed in the annular space 280 between the retaining ring 170 and the subcarrier 160. Preferably, the ports 325 are evenly spaced around the annular space 280 between the retaining ring 170 and the subcarrier 160. More preferably, the CMP apparatus 100 further includes a flushing fluid supply 330, a slurry supply 335, and a valve 340 for alternating between the two, and the ports 325 are further adapted to flush the annular space 280 between the retaining ring 170 and the subcarrier 160 during a maintenance operation.

In yet another aspect, the present invention is directed to a polishing surface 125 having a number of depressions or recesses non-uniformly concentrated across the polishing surface to control the removal rate across the surface of the substrate 105. As noted above, the recesses in the polishing surface 125 act to distribute the chemical or slurry between the polishing surface and the surface of a substrate 105 placed thereon. Generally, the recesses can be a number of grooves 345 or a number of pits or cavities 350, that may or may not have the same dimensions and may or may not be uniformly spaced apart across the polishing surface 125. That is the recesses comprise grooves 345 or cavities 350 having a non-uniform spacing radially across the polishing surface grooves 345 or cavities 350, or grooves 345 or cavities 350 having a non-uniform cross-sectional area.

Figure 13A:
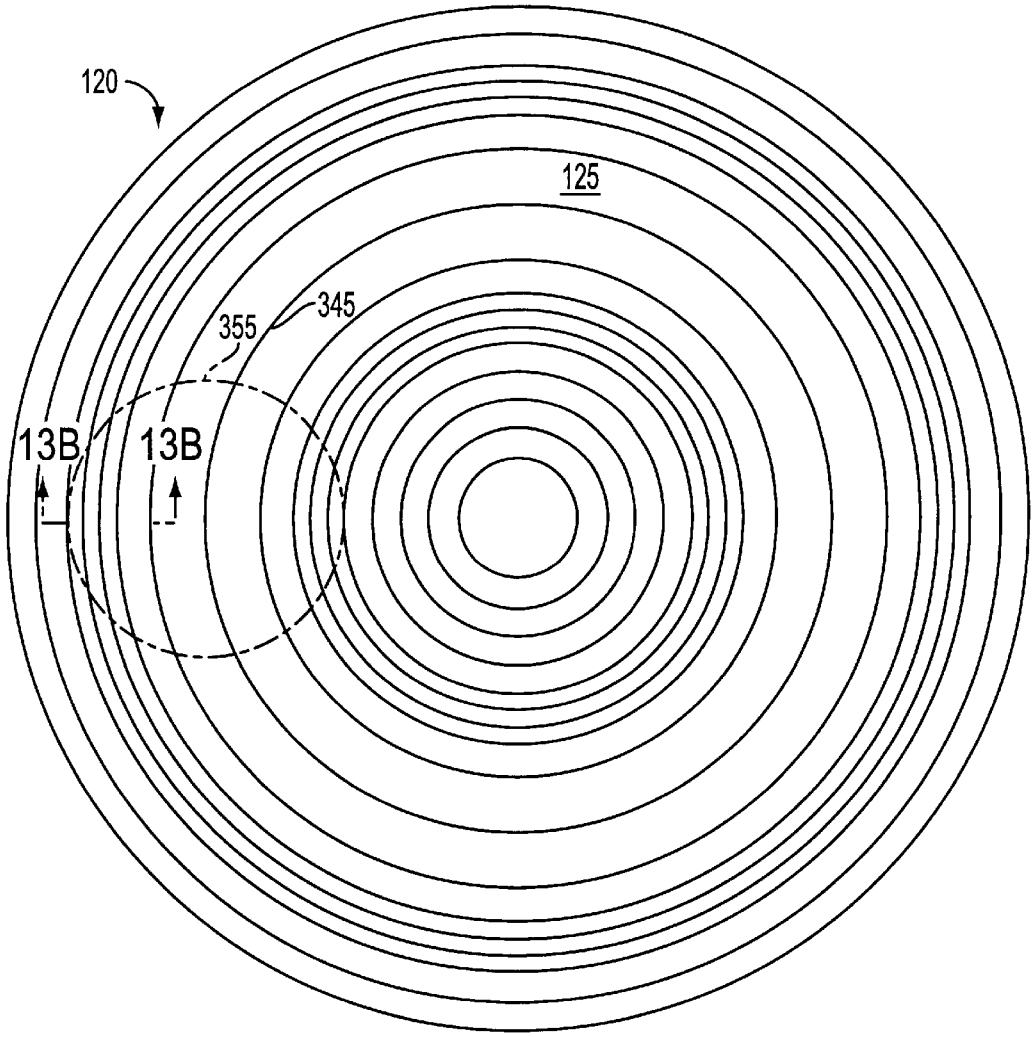
FIG. 13A is a diagrammatic illustration showing a plan view of a polishing surface having non-uniformly spaced grooves according to an embodiment of the present invention.
Figure 13B:
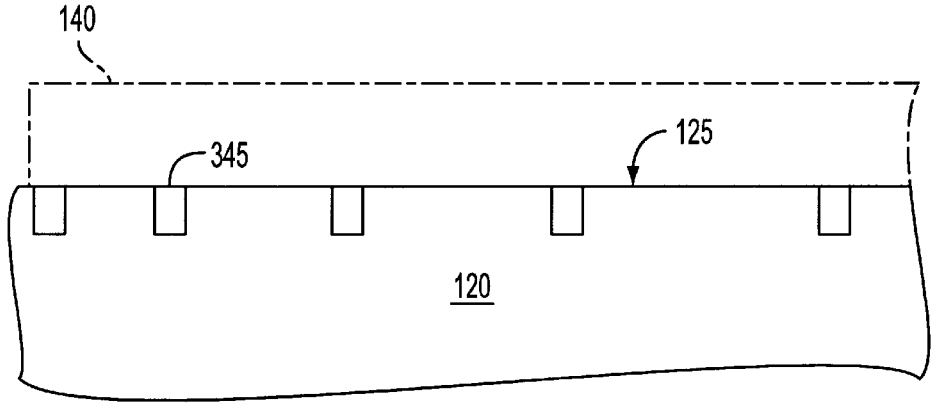
FIG. 13B is a diagrammatic illustration showing a partial cross-sectional side view of the polishing surface of FIG. 13A.

Referring to FIG. 13A, in one embodiment where the polishing surface 125 is rotatable surface having a disc shape, the recesses include a number of concentric grooves 345 having a uniform depth and width that are space non-uniformly across the polishing surface. Note that in FIG. 13A, and in FIGS. 14, 15, 16 and 17 which follow, because of the small width of the grooves 345 relative to the polishing surface 125, the grooves are shown as single solid lines. These lines are meant to illustrate the placement of the grooves 345 on the polishing surface 125 only and should not be construed to convey any information as to the dimension of the grooves. Generally, because of the greater surface area of the polishing surface 125 in contact with the substrate 105 in regions where the grooves 345 are spaced farther apart, as shown in FIG. 13B, the removal rate in this region is greater than in other regions. Thus positioning the polishing head 140 as shown by phantom line 355 in FIGS. 13A and 13B, would provide a higher rate of removal in the center of the substrate 105 than at the edge which periodically moves through regions having a greater concentration of grooves 345 (or lower surface area between the grooves). This is particularly desirable in processing substrates having layers of material, such as copper, which due to the characteristics of the material and the deposition process tend to have a convex shape. For a polishing surface 125 having grooves 345 as shown in FIG. 13A, it has been found that varying the varying the grooves from a density of grooves from about 20 grooves per radial linear inch in a first region to about 1 groove in a second region provides a difference in removal rate between the first region and the second region of at least 5 percent, with the first region providing a lower removal rate than the second region.

Figure 14:
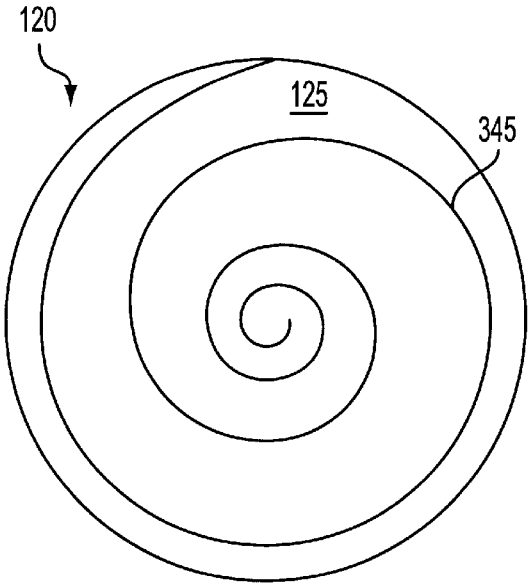
FIG. 14 is a diagrammatic illustration showing a plan view of an alternative embodiment of a polishing surface having a non-uniformly spaced spiral groove.
Figure 15:
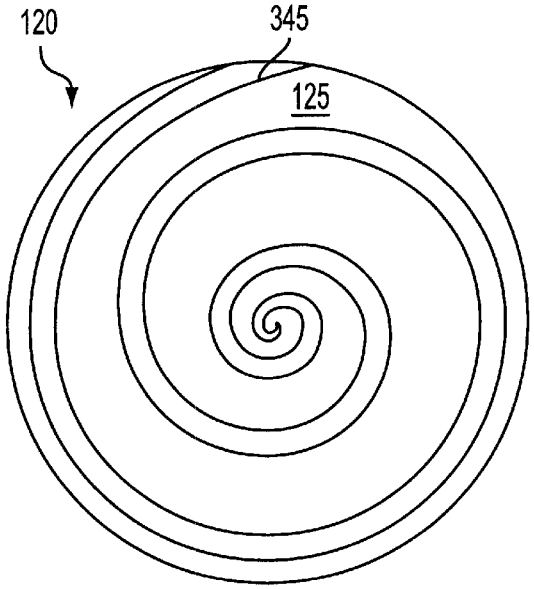
FIG. 15 is a diagrammatic illustration showing a plan view of an alternative embodiment of a polishing surface having a number of non-uniformly spaced spiral grooves.
Figure 16:
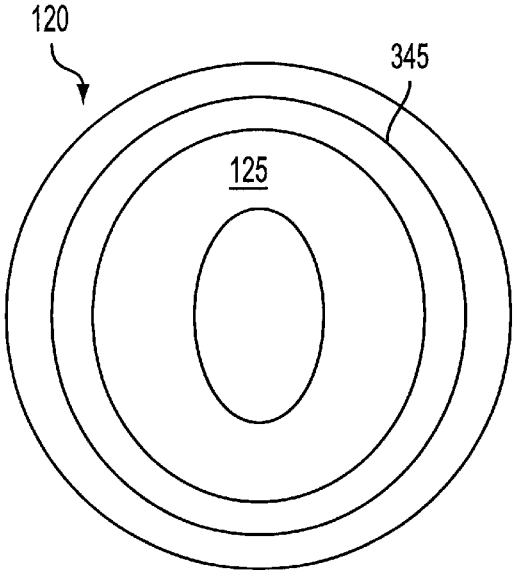
FIG. 16 is a diagrammatic illustration showing a plan view of an alternative embodiment of a polishing surface having non-uniformly spaced concentric elliptical grooves.
Figure 17:
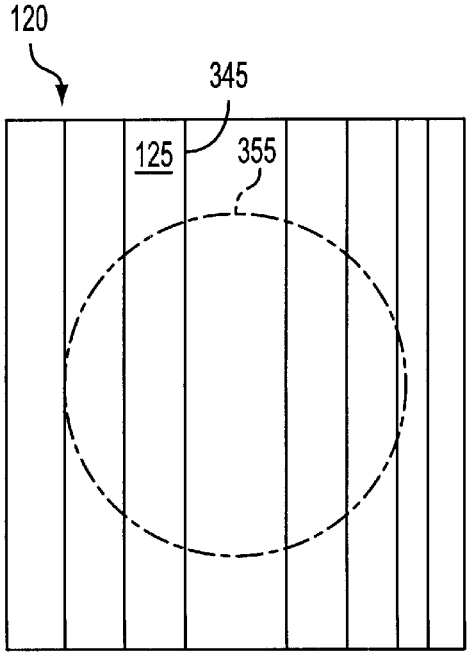
FIG. 17 is a diagrammatic illustration showing a plan view of an embodiment of a linear polishing surface having non-uniformly spaced parallel grooves.

Alternative designs and patterns for polishing surfaces 125 having a plurality of non-uniformly spaced grooves 345 are shown in FIGS. 14 through 17. FIG. 14 is a diagrammatic illustration showing a plan view of an embodiment of a polishing surface 125 having a single non-uniformly spaced spiral groove 345. The groove 345 is spiraled or wound in such a way as to provide regions having lower surface area between the groove near the center and edge of the polishing surface 125 and a higher surface area in the region in between. FIG. 15 is a diagrammatic illustration showing a plan view of an embodiment of a polishing surface 125 having a number of non-uniformly spaced spiral grooves 345. Again the grooves 345 are spaced apart and wound to provide regions having lower surface area between the groove near the center and edge of the polishing surface 125 and a higher surface area in the region in between. FIG. 16 is a diagrammatic illustration showing a plan view of an embodiment of a polishing surface 125 having non-uniformly spaced concentric elliptical grooves 345. FIG. 17 is a diagrammatic illustration showing a plan view of an embodiment of a linear polishing surface 125 having non-uniformly spaced parallel grooves 345. It should be noted that in this embodiment the linear polishing surface 125 can be either a fixed linear surface over which the polishing head 140 is moved or a rotating belt (not shown).

Figure 18:
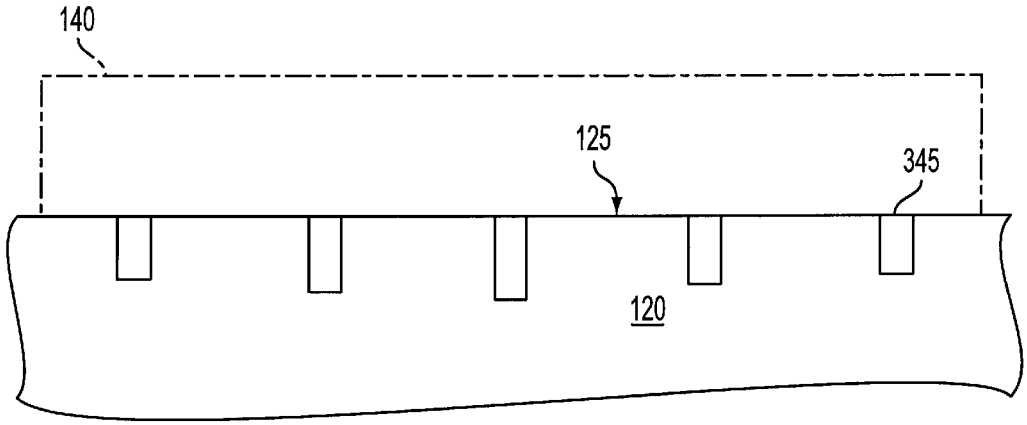
FIG. 18 is a diagrammatic illustration showing a partial cross-sectional view of a polishing surface having a plurality of uniformly spaced grooves having a non-uniform depth according to an embodiment of the present invention.
Figure 19:
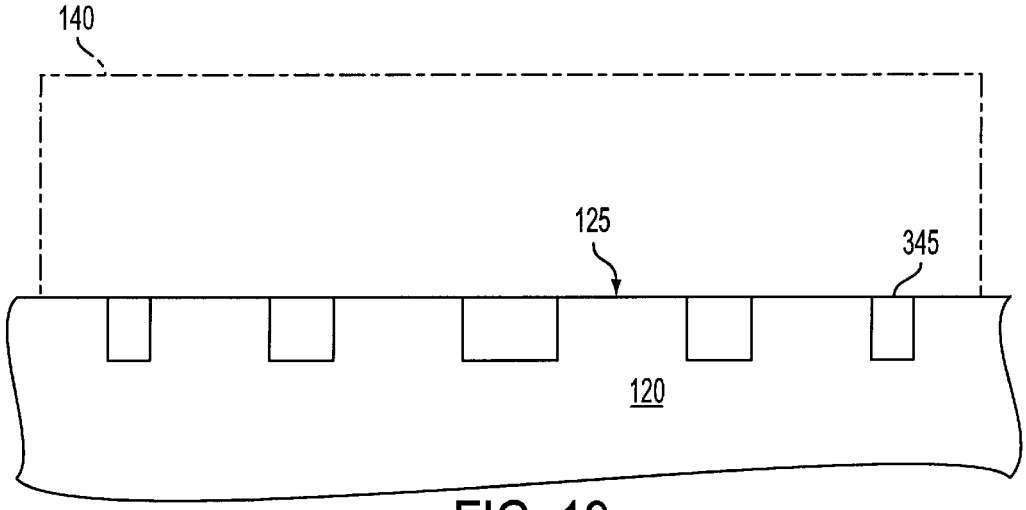
FIG. 19 is a diagrammatic illustration showing a partial cross-sectional view of a polishing surface having a plurality of uniformly spaced grooves having a non-uniform width according to an embodiment of the present invention.
Figure 20:
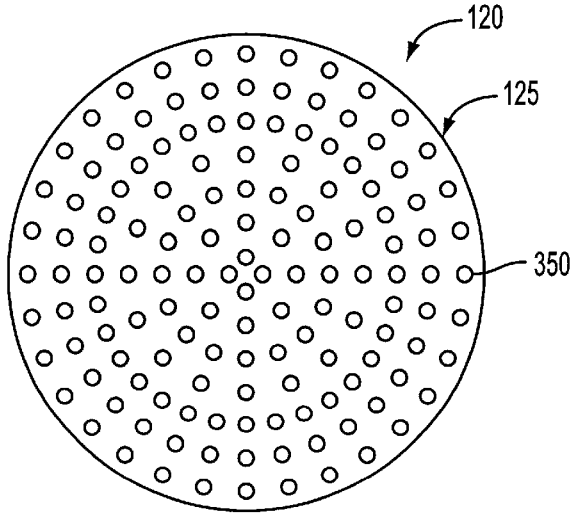
FIG. 20 is a diagrammatic illustration showing a plan view of a polishing surface having non-uniformly spaced cavities according to an embodiment of the present invention.

FIGS. 18 through 20 show additional alternative designs and patterns for polishing surfaces 125 in which the spacing between the recesses is relatively uniform and the dimensions of the recesses are varied to provide different removal rates from one region to another. Referring to FIG. 18, a partial cross-sectional side view of an embodiment of a polishing surface 125 having a number of uniformly spaced grooves 345 having a uniform width and non-uniform depth is provided. In this embodiment, the surface area of the polishing surface 125 in contact with the substrate 105 is constant from region to region, and it is the varying amount of slurry that is brought to the region by the varying depths of the grooves 345 that controls the difference in removal rates. This embodiment is useful in processes using a slurry having an abrasive material, and particularly useful in processes in which the chemical reactivity of the slurry is an important component of the polishing process.

FIG. 19 is a diagrammatic illustration showing a partial cross-sectional side view of a polishing surface 125 having a number of uniformly spaced grooves 345 having a non-uniform width according to an embodiment of the present invention. As above, the variation in surface area in contact with the substrate 105 provides the difference in removal rate. FIG. 20 is a diagrammatic illustration showing a plan view of a polishing surface 125 having uniformly spaced non-uniformly sized cavities 350 according to an embodiment of the present invention. Note, the size and the shape of the cavities 350 shown in FIG. 20 are provided for illustrative purposes only and should not be construed to convey any limitation as to the dimension or shape of the cavities, rather than cavities can be regularly or irregularly shaped and have dimensions ranging from a fraction of a millimeter to several millimeters. Again, the variation in surface area in contact with the substrate 105 provides the difference in removal rate. Although not shown it will be readily appreciated that the variation in removal rate could also be accomplished with uniformly sized cavities 350 spaced non-uniformly across the polishing surface 125, or with uniformly spaced cavities having a uniformly sized opening and a varying depth.

Figure 21:
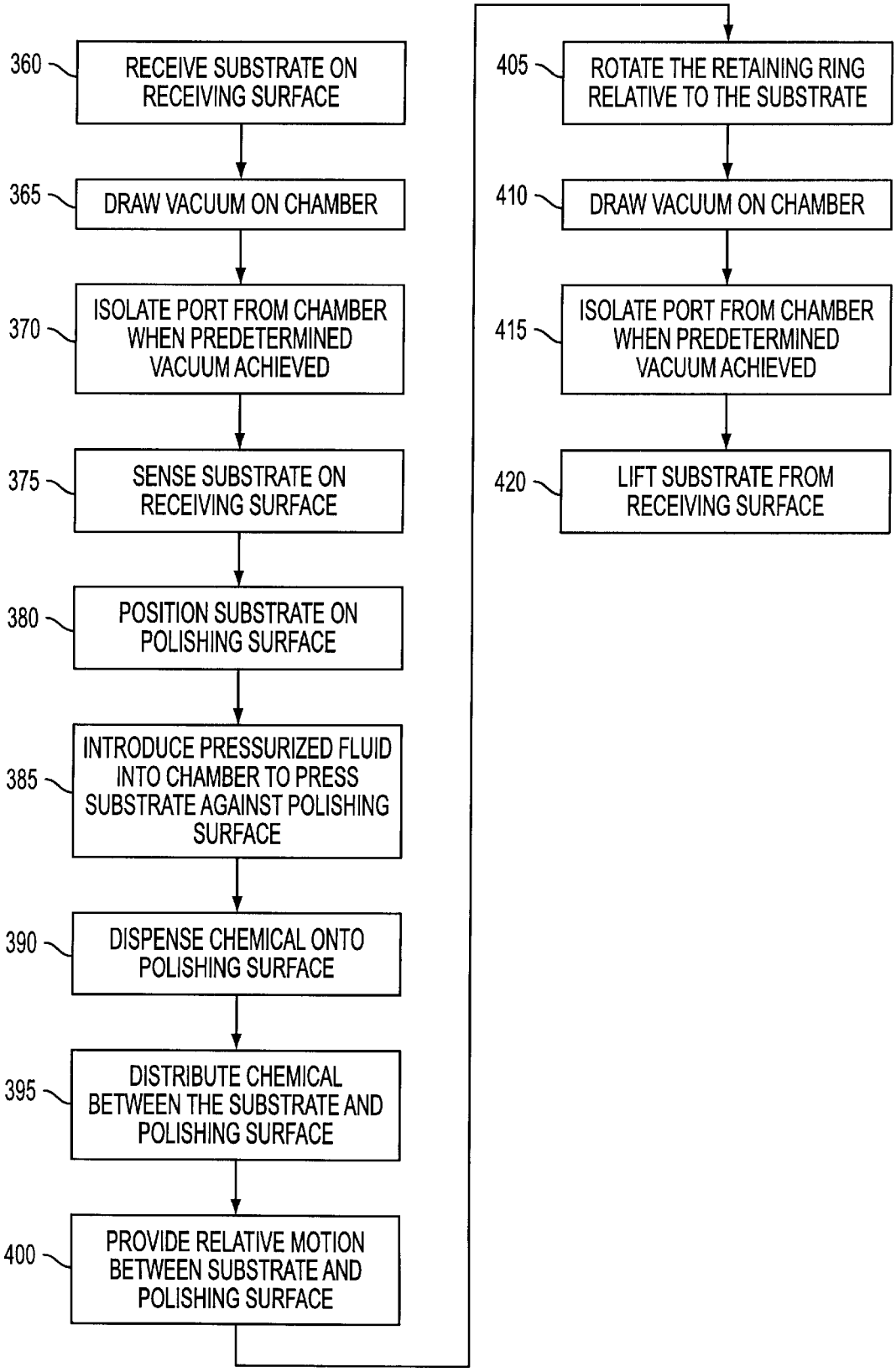
FIG. 21 is a flowchart showing an embodiment of a process for polishing or planarizing a substrate according to an embodiment of the present invention.

A method of operating a CMP apparatus 100 according to the present invention will now be described with reference to FIG. 21. In an initial or loading step a substrate 105 is received on the receiving surface 190 of the flexible member 185. (Step 360) Vacuum is drawn on the lower cavity 215 through the port 225 (Step 365) until a predetermined vacuum has been achieved and the port is isolated. (Step 370) Optionally, the presence of a substrate 105 on the receiving surface 190 is sensed by the switching of the vacuum switch 240 coupled to the port 225. (Step 375) The substrate 105 is positioned on the polishing surface 225 (Step 380) and a pressurized fluid introduced into the lower cavity 215 to press the substrate against the polishing surface 125. (Step 385) A chemical, such as water or a slurry, is dispensed onto the polishing surface 125 (Step 390) and distributed between the substrate 105 and the polishing surface via recesses in the polishing surface. (Step 395) These recesses may be non-uniformly spaced and/or sized grooves 345 or cavities 350 to provide a varying removal rate across the polishing surface 125 as described above. Relative motion is provided between the polishing surface 125 and the substrate 105 to polish the substrate. (Step 400) Optionally, the retaining ring 170 is rotated at a different speed relative to the subcarrier 160 and the substrate 105 held thereon to reduce if not eliminate the effect of a high or low spot on the lower surface 205 of the retaining ring 170 on the removal rate. (Step 405) After polishing is complete and rotation of the polishing head 140, retaining ring 170 and polishing platen 115 is stopped, vacuum is again drawn on the lower cavity 215 (Step 410) until the predetermined vacuum has been achieved (Step 415), and the substrate 105 is lifted from the polishing surface 125. (Step 420).

Some of the important aspects of the present invention will now be repeated to further emphasize their structure, function and advantages.

The invention is directed to a polishing head for positioning a substrate having a surface on a polishing surface of a polishing apparatus. The polishing head includes a carrier, a subcarrier carried by the carrier and adapted to hold the substrate during a polishing operation and a retaining ring rotatably disposed about the subcarrier. The retaining ring has a lower surface that is substantially flush with the surface of the substrate and is in contact with the polishing surface during the polishing operation. The retaining ring capable of rotating relative to the substrate held on the subcarrier to inhibit non-planar polishing of the surface of the substrate.

In one embodiment, the subcarrier is capable of rotating the substrate held thereon during the polishing operation and the retaining ring is capable of rotating at a different speed than the substrate held on the subcarrier.

In another embodiment, the polishing head further includes a backing ring in a facing relationship with an upper surface of the retaining ring and separated from the retaining ring by a bearing. The backing ring is adapted to apply pressure to the retaining ring during the polishing operation. The bearing can be a ball bearing, fluid dynamic bearing, roller bearing, or a taper bearing. Preferably, the retaining ring further includes a first lip that engages with a second lip on the backing ring when the carrier is lifted from the polishing surface to couple the retaining ring to the backing ring. In one version of this embodiment, the first lip includes a number of bolts, each of the bolts having a shaft portion and a head with a surface projecting radially outward from the shaft portion to engage with the second lip on the backing ring when the carrier is lifted from the polishing surface.

In another embodiment, the polishing head further includes a drive mechanism coupled to the retaining ring causes the retaining ring to rotate relative to the subcarrier during the polishing operation. Alternatively, friction forces between the retaining ring and the polishing surface can cause the retaining ring to rotate relative to the subcarrier during the polishing operation.

The polishing head of the present invention is particularly useful in a polishing apparatus, such as a CMP. Typically, the apparatus further includes a polishing surface and a slurry dispensing mechanism adapted to dispense slurry onto the polishing surface during the polishing operation. Alternatively, the apparatus has a polishing surface with a fixed abrasive thereon and a chemical dispensing mechanism adapted to dispense a chemical onto the polishing surface during the polishing operation.

In another aspect, a method is provided for polishing a substrate having a surface using a polishing apparatus with a polishing surface and a carrier provided with a subcarrier and a retaining ring circumferentially disposed about the subcarrier and has a lower surface. The method includes steps of positioning the substrate on the subcarrier so that the surface of the substrate is substantially flush with the lower surface of the retaining ring, pressing the surface of the substrate and the lower surface of the retaining ring against the polishing surface to polish the surface of the substrate and rotating the retaining ring relative to the subcarrier to inhibit non-planar polishing of the surface of the substrate. The method can further include the steps of rotating the substrate held on the subcarrier during the polishing operation, and the step of rotating the retaining ring includes the step of rotating the retaining ring at a different speed than that of the substrate held on the subcarrier.

In one embodiment, the step of rotating the retaining ring involves the step of rotating the retaining ring with the friction forces exerted on the lower surface of the retaining ring by the polishing surface. Alternatively, the polishing apparatus further includes a drive mechanism coupled to the retaining ring, and in which the step of rotating the retaining ring includes the step of operating the drive mechanism to rotate the retaining ring.

In yet another aspect, the polishing head includes means for rotatably securing the retaining ring to the carrier so as to permit the retaining ring to rotate relative to the subcarrier and thus inhibit polishing of the substrate. In one embodiment, the means for enabling the retaining ring to rotate is capable of rotating the retaining ring at a different speed than the substrate held on the subcarrier.

In another embodiment, the carrier further includes a backing ring in a facing relationship with an upper surface of the retaining ring to apply pressure to the retaining ring during the polishing operation, and the means for enabling the retaining ring to rotate relative to the substrate includes a bearing separating the backing ring from the retaining ring.

In yet another embodiment, the polishing head further includes a drive mechanism coupled to the retaining ring to cause the retaining ring to rotate relative to the substrate held on the subcarrier during the polishing operation. Alternatively, friction forces between the retaining ring and the polishing surface causes the retaining ring to rotate relative to the subcarrier during the polishing operation.

The invention is also directed to a polishing head for positioning a substrate having a surface on a polishing surface of a polishing apparatus. The polishing head including a carrier adapted to hold the substrate during a polishing operation. The carrier has a lower surface, and a flexible member secured to the carrier and extending across the lower surface, a corner ring piece disposed between the flexible member and the lower surface to form a cavity between the flexible member and the lower surface. The carrier is provided with a passageway in communication with the lower surface for introducing a pressurized fluid into the cavity. The flexible member has a receiving surface adapted to engage the substrate so as to press the substrate against the polishing surface during the polishing operation. The flexible member has a thickness and a number of holes extending through the thickness to the receiving surface for applying pressure directly to the substrate. Preferably, the flexible member is further adapted to seal with the substrate on the receiving surface to enable the cavity to be pressurized.

In one embodiment, the carrier further includes a subcarrier carried by the carrier, and the flexible member is secured to the subcarrier and extends across a lower surface of the subcarrier.

In another embodiment, the polishing apparatus further includes a drive mechanism to rotate the carrier during the polishing operation, and the number and size of the number of holes is selected to provide sufficient frictional forces between the receiving surface of the flexible member and the substrate to impart rotational energy to substrate.

In yet another embodiment, the lower surface of the carrier includes a port in communication with the passageway. The port adapted to admit a pressurizing fluid into the cavity during the polishing operation. In one version of this embodiment, the lower surface of the carrier further includes at least one groove adapted to distribute the pressurizing fluid from the port throughout the cavity. In another version, the port is further adapted to draw a vacuum on the cavity, and the flexible member and the substrate serves as a valve to isolate the port from the cavity when a predetermined vacuum has been achieved. Preferably, the predetermined vacuum is selected to hold the substrate to receiving surface during load and unload operations before and after the polishing operation. More preferably, the polishing apparatus further includes a vacuum switch coupled to the port, and the predetermined vacuum is selected to switch the vacuum switch when a substrate is held on the receiving surface.

The polishing head of the present invention is particularly useful in a polishing apparatus, such as a CMP. Typically, the apparatus further includes a polishing surface and a slurry dispensing mechanism adapted to dispense slurry onto the polishing surface during the polishing operation. Alternatively, the apparatus has a polishing surface with a fixed abrasive thereon and a chemical dispensing mechanism adapted to dispense a chemical onto the polishing surface during the polishing operation.

In another aspect, a method is provided for polishing a substrate having a surface using a polishing apparatus with a polishing surface and a carrier provided with a lower surface and a flexible member extending across the lower surface. The flexible member has a receiving surface and a thickness and a number of holes extending through the thickness to the receiving surface. The method includes steps of positioning the substrate between the carrier and the polishing surface so that the flexible member engages the substrate and the surface of the substrate rests on the polishing surface and applying pressure to the flexible member to press the substrate against the polishing surface and thus polish the surface of the substrate. The pressure extending through the holes so as to be exerted directly against the substrate.

In one embodiment, the carrier further includes a corner ring piece disposed between the flexible member and the lower surface to form a cavity, the lower surface of the carrier having a port adapted to introduce a pressurized fluid into the cavity, and the step of applying pressure to the flexible member involves admitting the pressurized fluid into the cavity through the port. Preferably, where the polishing apparatus further includes a drive mechanism to rotate the carrier during the polishing operation, and the method further includes the step of providing torque to the substrate through the flexible member. More preferably, the number and size of the number of holes extending through the thickness of the flexible member is selected to provide sufficient frictional forces between the receiving surface of the flexible member and the substrate to impart rotational energy to substrate during the polishing operation.

In one embodiment, the port is further adapted to draw a vacuum on the cavity, and the method further includes a loading step of drawing a vacuum on the cavity to hold the substrate to the receiving surface. Preferably, the loading step of drawing further involves isolating the port from the cavity when a predetermined vacuum has been achieved using the flexible member and the substrate as a valve. More preferably, the polishing apparatus has a vacuum switch coupled to the port, and the loading step involves sensing the presence of the substrate on the receiving surface by switching the vacuum switch when the predetermined vacuum has been achieved. The method can further include the step of during an unload step after the polishing operation drawing a vacuum on the cavity to hold the substrate to the receiving surface before lifting the carrier from the polishing surface.

In yet another aspect, a polishing apparatus for polishing a substrate is provided having means for applying a pressurized fluid directly to the substrate to press the substrate against the polishing surface, and means for transferring rotational energy from the carrier to substrate during the polishing operation. Preferably, the means for applying a pressurized fluid directly to the substrate includes a flexible member attached to the lower surface of the carrier on which the substrate is held during the polishing operation.

The flexible member has a receiving surface adapted to engage the substrate, a thickness, and a number of holes extending through the thickness to the receiving surface for applying pressure directly to the substrate. More preferably, the means for transferring rotational energy from the carrier to substrate includes the receiving surface of the flexible member, and the number and size of the number of holes is selected to provide sufficient frictional forces between the receiving surface and the substrate to impart rotational energy to substrate.

The invention is also directed to a polishing head for positioning a substrate having a surface on a polishing surface of a polishing apparatus having a carrier adapted to hold the substrate during a polishing operation. The carrier has a lower surface, and a flexible member secured to the carrier and extending across the lower surface. The flexible member has a receiving surface for engaging the substrate. The carrier is provided with a port extending through the lower surface for supplying suction, a corner ring piece disposed between the flexible member and the lower surface in the vicinity of the port. The flexible member has a thickness and at least one hole extending through the thickness to the receiving surface, the hole being in substantial alignment with the port. The flexible member is movable from first position in which it is spaced apart from the lower surface in the vicinity of the port and a second position in which the flexible member engages the lower surface around the port and the hole at least partially registers with the port so that suction can be supplied to the port to retain the substrate to the receiving surface during at least a portion of the polishing operation whereby the spacer substantially limits the application of suction to only a portion of the substrate and thus minimizes undesirable stresses on the remainder of the substrate. Preferably, the flexible member is adapted to seal with the substrate on the receiving surface to enable a vacuum to be drawn on the cavity.

In one embodiment, the flexible member and the substrate serve as a valve to isolate the port from the cavity when a predetermined vacuum has been achieved, whereby deformation of the flexible member and stress on the substrate held on the receiving surface is reduced. In one version of this embodiment, the spacer includes a thickness separating the flexible member from the lower surface of the carrier, and the thickness is selected to further reduce deformation of the flexible member when a vacuum is drawn on the cavity, whereby stress on the substrate held on the receiving surface is reduced. In another version, the polishing apparatus further includes a vacuum switch coupled to the port, and the presence of the substrate on the receiving surface is sensed when the predetermined vacuum has been achieved by switching of the vacuum switch.

In another embodiment, the polishing apparatus further includes a drive mechanism to rotate the carrier during the polishing operation, and the size of the hole is selected to provide sufficient frictional forces between the receiving surface of the flexible member and the substrate to impart rotational energy to substrate.

In yet another embodiment, a number of holes extend through the thickness of the flexible member to the receiving surface. In one version of this embodiment, the carrier further includes a passageway in communication with the port for introducing a pressurized fluid into the cavity during the polishing operation, and the number of holes is adapted to enable the pressurized fluid to be applied directly to the substrate through the number of holes to press the substrate against the polishing surface during the polishing operation. In another version, the polishing apparatus further includes a drive mechanism to rotate the carrier during the polishing operation, and the number and size of the holes is selected to provide sufficient frictional forces between the receiving surface of the flexible member and the substrate to impart rotational energy to substrate.

In another aspect, a method is provided for polishing a substrate having a surface using a polishing apparatus with a polishing surface and a carrier adapted to hold the substrate during a polishing operation. The carrier has a lower surface with a flexible member secured thereto, and a corner ring piece disposed between the flexible member and the lower surface to form a cavity between the flexible member and the lower surface.

The lower surface of the carrier is provided with a port adapted to draw a vacuum on the cavity. The flexible member has a receiving surface adapted to receive the substrate. The flexible member has a thickness and at least one hole extending through the thickness to the receiving surface. The method includes steps of receiving the substrate on the receiving surface, drawing a vacuum on the cavity to hold the substrate to the carrier, and positioning the surface of the substrate on the polishing surface. Preferably, the step of drawing a vacuum on the cavity includes the step of isolating the port from the cavity when a predetermined vacuum has been achieved using the flexible member and the substrate as a valve. More preferably, the polishing apparatus further includes a vacuum switch coupled to the port, and the method includes the further step of sensing the presence of the substrate on the receiving surface by switching the vacuum switch when the predetermined vacuum has been achieved.

The invention is also directed to a polishing head for positioning a substrate having a surface on a polishing surface of a polishing apparatus. The polishing head including a carrier having a bottom surface. The bottom surface includes a lower surface adapted to hold the substrate during a polishing operation. The carrier is provided with a number of ports extending through the bottom surface around the lower surface for dispensing a polishing substance onto the polishing surface during the operation. Generally, the ports are adapted to dispense a slurry including an abrasive material onto the polishing surface. Alternatively, where the polishing surface includes a fixed abrasive thereon, the ports are adapted to dispense water onto the polishing surface during the polishing operation.

In one embodiment, the ports are disposed within the retaining ring.

In another embodiment, the carrier further includes a subcarrier having a receiving surface on which the substrate is held during the polishing operation, and the retaining ring is rotatably disposed about the subcarrier and separated from the subcarrier by an annular space. In one version of this embodiment, the ports are disposed within the annular space between the retaining ring and the subcarrier. Preferably, the ports are evenly spaced around the annular space between the retaining ring and the subcarrier. More preferably, there are from 2 to 30 ports. Most preferably, the ports are further adapted to flush the annular space between the retaining ring and the subcarrier during a maintenance operation.

The polishing head of the present invention is particularly useful in a polishing apparatus, such as a CMP. Typically, the apparatus further includes a polishing surface and the ports are adapted to dispense a slurry including an abrasive material onto the polishing surface during the polishing operation. Alternatively, the polishing surface has a fixed abrasive thereon and the ports are adapted to dispense water onto the polishing surface during the polishing operation.

In another aspect, a method is provided for polishing a substrate having a surface using a polishing apparatus with a polishing surface and a carrier having a bottom surface adapted to hold the substrate during a polishing operation. The method includes the steps of positioning the substrate on the lower surface of the carrier, urging the carrier towards the polishing surface so as to press the surface of the substrate against the polishing surface and dispensing a polishing substance through the bottom surface of the carrier onto the polishing surface.

In one embodiment, the polishing surface has a fixed abrasive thereon and the step of dispensing a chemical onto the polishing surface includes the step of dispensing water onto the polishing surface. Alternatively, the chemical mechanical polishing apparatus further includes a slurry supply capable of supplying slurry to the number of ports, and the step of dispensing a chemical onto the polishing surface includes the step of dispensing slurry onto the polishing surface. In one version of this embodiment, the polishing apparatus further includes a flushing fluid supply capable of supplying a flushing fluid to the number of ports, and a valve for alternating between the slurry supply and the flushing fluid supply, and the method includes the further step, after polishing the substrate, of flushing the number of ports.

In yet another aspect, a polishing head for positioning a substrate having a surface on a polishing surface of a polishing apparatus is provided having means for dispensing a chemical from the polishing head onto the polishing surface during the polishing operation.

In one embodiment, the means for dispensing a chemical from the polishing head includes means for dispensing a slurry including an abrasive material onto the polishing surface. Alternatively, the polishing surface has fixed abrasive thereon and the means for dispensing a chemical from the polishing head includes means for dispensing water onto the polishing surface during the polishing operation.

In another embodiment, the means for dispensing a chemical from the polishing head includes a number of ports are disposed within the retaining ring. Preferably, the carrier further includes a subcarrier having a receiving surface on which the substrate is held during the polishing operation, and the retaining ring is rotatably disposed about the subcarrier and separated from the subcarrier by an annular space. More preferably, the ports are disposed within the annular space between the retaining ring and the subcarrier.

The invention is also directed to a polishing apparatus for removing material from a surface of a substrate. The polishing apparatus includes a polishing head adapted to hold the substrate during a polishing operation, and a polishing surface with a number of recesses to distribute a chemical between the substrate held on the polishing head and the polishing surface when there is relative motion between the substrate and the polishing surface. The number of recesses has a non-uniform spacing across the polishing surface to provide a variable rate of removal of material across the polishing surface. The spacing of the recesses across the polishing surface varies from a first region to a second region to provide a difference in removal rate between the first region and the second region.

In one embodiment, the number of recesses include grooves having a non-uniform spacing radially across the polishing surface. In one version of this embodiment, the grooves have a non-uniform cross-sectional area. Preferably, the spacing of the number of recesses across the polishing surface varies from the first region to the second region to provide a difference in removal rate between the first region and the second region of at least 5 percent. More preferably, the number of grooves is more concentrated in the first region than in the second region, and the first region provides a lower removal rate than the second region. The spacing of the number of grooves across the polishing surface varies from 20 grooves per linear inch in a first region to 2 grooves per linear inch in a second region. Preferably, the grooves have a substantially uniform depth and a substantially uniform width. Generally, there are more grooves per linear inch in the first region than in the second region, and the first region provides a lower removal rate than the second region. The grooves can be parallel grooves, concentric circular grooves, concentric elliptical grooves, spiral grooves having a variable pitch across the spiral or a single spiral groove.

Alternatively, the recesses can include a number of open cavities or pits in the polishing surface.

When the polishing surface has a fixed abrasive thereon and the recesses are adapted to distribute water between the substrate held on the polishing head and the polishing surface during the polishing operation. Alternatively, the recesses are adapted to distribute a slurry including an abrasive material between the substrate held on the polishing head and the polishing surface during the polishing operation.

In still another aspect, a polishing apparatus is provided for removing material from a surface of a substrate. The polishing apparatus includes a polishing head adapted to hold the substrate during a polishing operation, and a polishing surface having a number of recesses therein to distribute a chemical between the substrate held on the polishing head and the polishing surface when there is relative motion between the substrate and the polishing surface. The recesses have a non-uniform size across the polishing surface that varies from a first region to a second region to provide a variable rate of removal of material across the polishing surface from the first region and the second region.

In one embodiment, the recesses include a number of cavities in the polishing surface, and the depth of the number of cavities varies from the first region to the second region to provide a difference in removal rate between the first region and the second region.

In another embodiment, the recesses include a number of cavities in the polishing surface, each of the cavities has a cross-sectional area parallel to the polishing surface, and the cross-sectional area of each of the number of cavities varies from the first region to the second region to provide a difference in removal rate between the first region and the second region.

In yet another embodiment, the recesses include a number of grooves in the polishing surface has a depth, and the depth of the number of grooves varies from the first region to the second region to provide a difference in removal rate between the first region and the second region.

In still another embodiment, the recesses include a number of grooves in the polishing surface, each of the grooves has a width, and the width of each of the number of grooves varies from the first region to the second region to provide a difference in removal rate between the first region and the second region.

In another aspect, a method is provided for removing material from a surface of a substrate using a polishing apparatus having a polishing head adapted to hold the substrate during a polishing operation, and a polishing surface having a number of recesses to distribute a chemical between the substrate held on the polishing head and the polishing surface when there is relative motion between the substrate and the polishing surface. The number of recesses has a non-uniform spacing across the polishing surface to provide a variable rate of removal of material across the polishing surface. The method includes steps of positioning the substrate on the polishing head, pressing the surface of the substrate against the polishing surface, dispensing a chemical onto the polishing surface, and providing a relative motion between the substrate and the polishing surface to remove material from the surface of the substrate at a rate that varies across the polishing surface.

In one embodiment, the spacing of the recesses across the polishing surface varies from a first region to a second region, and the step of providing a relative motion between the substrate and the polishing surface to remove material from the surface of the substrate includes the step of providing a difference in removal rate between the first region and the second region.

In another embodiment, the recesses include a number of grooves has a substantially uniform depth and a substantially uniform width.

In yet another embodiment, the recesses include a the number of cavities, each of the number of cavities has a substantially uniform depth and a substantially uniform cross-sectional area parallel to the polishing surface.

It is to be understood that even though numerous characteristics and advantages of certain embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed.

What is claimed is:

1. A polishing head for positioning a substrate having a surface on a polishing surface of a polishing apparatus, the polishing head comprising a carrier, a subcarrier carried by the carrier and adapted to hold the substrate during a polishing operation and a retaining ring rotatably disposed about the subcarrier, the retaining ring having a lower surface that is substantially flush with the surface of the substrate and is in contact with the polishing surface during the polishing operation, the retaining ring adapted for rotating relative to the substrate held on the subcarrier to inhibit non-planar polishing of the surface of the substrate.

2. The polishing head according to claim 1, wherein the subcarrier is adapted for rotating the substrate held thereon during the polishing operation and wherein the retaining ring is adapted for rotating at a different speed than the substrate held on the subcarrier.

3. The polishing head according to claim 1, further comprising a backing ring in a facing relationship with an upper surface of the retaining ring and separated from the retaining ring by a bearing, the backing ring adapted to apply pressure to the retaining ring during the polishing operation.

4. The polishing head according to claim 3, wherein the bearing is selected from the group consisting of a ball bearing, fluid dynamic bearing, roller bearing, and a taper bearing.

5. The polishing head according to claim 3, wherein the retaining ring further comprises a first lip that engages with a second lip on the backing ring when the carrier is lifted from the polishing surface to couple the retaining ring to the backing ring.

6. The polishing head according to claim 5, wherein the first lip comprises a plurality of bolts, each of the bolts having a shaft portion and a head having a surface projecting radially outward from the shaft portion to engage with the second lip on the backing ring when the carrier is lifted from the polishing surface.

7. The polishing head according to claim 1, wherein a drive mechanism coupled to the retaining ring causes the retaining ring to rotate relative to the subcarrier during the polishing operation.

8. The polishing head according to claim 1, wherein friction forces between the retaining ring and the polishing surface causes the retaining ring to rotate relative to the subcarrier during the polishing operation.

9. The polishing head according to claim 1, wherein the retaining ring is adapted for rotating about an axis perpendicular to the surface of the substrate held on the subcarrier.

10. The polishing head according to claim 1, wherein the retaining ring is adapted for rotating relative to the carrier.

11. A method of polishing a substrate having a surface using a polishing apparatus having a polishing surface, the method comprising steps of:

positioning the substrate on a polishing surface so that the surface of the substrate to be polished is in contact with the polishing surface;

a pressing the surface of the substrate against the polishing surface;

deforming the polishing surface surrounding the substrate in an annular region using a retaining ring to reduce a rate of removal of material from an edge of the substrate;

providing a relative motion between the polishing surface and the surface of the substrate to polish the surface of the substrate; and rotating the retaining ring relative to the surface of the substrate about an axis perpendicular to the surface of the substrate to inhibit non-planar polishing of the surface of the substrate.

12. The method according to claim 11 wherein the step of providing a relative motion between the polishing surface and the surface of the substrate comprises the step of rotating the substrate during the polishing operation, and wherein the step of rotating the retaining ring comprises the step of rotating the retaining ring at a different speed than that of the substrate.

13. The method according to claim 12 wherein the step of rotating the retaining ring comprises the step of rotating the retaining ring in a different direction than that of the substrate.

14. The method according to claim 11, wherein the substrate is a semiconductor substrate.

15. A polishing head for positioning a substrate having a surface on a polishing surface of a polishing apparatus, comprising a carrier, a subcarrier carried by the carrier and adapted to hold the substrate during a polishing operation and a retaining ring circumferentially disposed about the subcarrier, the retaining ring having a lower surface that is substantially flush with the surface of the substrate and is in contact with the polishing surface during the polishing operation, and means for rotatably securing the retaining ring to the carrier so as to permit the retaining ring to rotate relative to the subcarrier and thus inhibit polishing of the substrate.

16. The polishing head according to claim 15, wherein the subcarrier is adapted for rotating the substrate held thereon during the polishing operation and wherein the means for enabling the retaining ring to rotate is adapted for rotating the retaining ring at a different speed than the substrate held on the subcarrier.

17. The polishing head according to claim 15, wherein the carrier further comprises a backing ring in a facing relationship with an upper surface of the retaining ring to apply pressure to the retaining ring during the polishing operation, and wherein the means for enabling the retaining ring to rotate relative to the substrate comprises a bearing separating the backing ring from the retaining ring.

18. The polishing head according to claim 15, further comprising a drive mechanism coupled to the retaining ring causes the retaining ring to rotate relative to the substrate held on the subcarrier during the polishing operation.

19. The polishing head according to claim 15, wherein friction forces between the retaining ring and the polishing surface causes the retaining ring to rotate relative to the subcarrier during the polishing operation.

20. The polishing head according to claim 15, wherein the means for rotatably securing the retaining ring to the carrier permits the retaining ring to rotate about an axis perpendicular to the surface of the substrate held on the subcarrier.

21. The polishing head according to claim 15, wherein the means for rotatably securing the retaining ring to the carrier further permits the retaining ring to rotate relative to the carrier.

22. A polishing head for positioning a substrate having a surface on a polishing surface of a polishing apparatus, the polishing head comprising a carrier, a subcarrier carried by the carrier and adapted to hold the substrate during a polishing operation, a retaining ring rotatably disposed about the subcarrier, the retaining ring having an upper surface and a lower surface that is substantially flush with the surface of the substrate and is in contact with the polishing surface during the polishing operation, the retaining ring adapted for rotating relative to the substrate held on the subcarrier, and a backing ring in a facing relationship with the upper surface of the retaining ring and separated from the retaining ring by a bearing, the backing ring adapted to apply pressure to the retaining ring during the polishing operation.

* * * * *